US006241579B1

(12) United States Patent
Miller, III et al.

(10) Patent No.: US 6,241,579 B1
(45) **Date of Patent: *Jun. 5, 2001**

(54) SURFACE POLISHING APPLICATOR SYSTEM AND METHOD

(75) Inventors: Paul D. Miller, III; Dennis L. Dehn, both of Dallas, TX (US)

(73) Assignee: Auto Wax Company, Inc., Dallas, TX (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/781,768

(22) Filed: Jan. 10, 1997

(51) Int. Cl.[7] ..... B24B 1/00

(52) U.S. Cl. ..... 451/28; 451/507; 451/524

(58) Field of Search ..... 451/523, 524, 451/525, 461, 507, 490; 206/210, 205, 825; 15/229.13

(56) References Cited

U.S. PATENT DOCUMENTS

| | | | | |
|---|---|---|---|---|
| 1,966,101 | * | 7/1934 | Miller | 15/229.13 |
| 4,150,955 | | 4/1979 | Samuelson . | |
| 4,264,337 | | 4/1981 | Fenster et al. . | |
| 4,421,526 | | 12/1983 | Strickman et al. . | |
| 4,484,419 | * | 11/1984 | Freerks | 451/523 |
| 4,512,859 | | 4/1985 | Inoue . | |
| 4,955,747 | | 9/1990 | Tarver . | |
| 4,962,562 | | 10/1990 | Englund et al. . | |
| 5,003,659 | * | 4/1991 | Paepke | 15/229.13 |
| 5,007,128 | | 4/1991 | Englund et al. . | |
| 5,066,724 | | 11/1991 | Reich et al. . | |
| 5,125,191 | | 6/1992 | Rhoades . | |
| 5,152,809 | | 10/1992 | Mattesky . | |
| 5,185,964 | | 2/1993 | Englund et al. . | |
| 5,203,883 | | 4/1993 | Perry . | |
| 5,295,333 | | 3/1994 | Püschner . | |
| 5,389,032 | * | 2/1995 | Beardsley | 451/461 |
| 5,396,737 | | 3/1995 | Englund et al. . | |
| 5,442,816 | | 8/1995 | Seketa . | |
| 5,476,416 | | 12/1995 | Kodate . | |

FOREIGN PATENT DOCUMENTS

| | | | | |
|---|---|---|---|---|
| 0 196 832 | | 10/1986 | (EP) . | |
| 0 628 382 A1 | | 12/1994 | (EP) . | |
| 1518431 | * | 7/1978 | (GB) | 451/523 |
| 1-97572 | | 4/1989 | (JP) . | |
| 4-11335 | | 2/1992 | (JP) . | |
| 95005920 | | 5/1994 | (JP) . | |
| 92/00153 | | 1/1992 | (WO) . | |
| 96/15877 | | 5/1996 | (WO) . | |

OTHER PUBLICATIONS

Video Tape entitled Auto Magic '6 Stages of Reconditioning' Complete Process—2:05;00) No. 91700, Auto Wax Co., Inc. Jan. 1994.

Video Tape entitled "Clay Magic—Clay Magic raceway 4 Minute Demo", Jul. 1994.

Video Tape entitled "Clay Magic—Miami Grand Prix 2 Minute Car Wash DR Spot", Mar. 1994.

Dialog Web patent family search results 1998 (2 sheets) including a one page Abstract of Japanese Patent JP 6093298 A, which is parent to Japanese Patent 95005920 B2.

(List continued on next page.)

*Primary Examiner*—Robert A. Rose
(74) *Attorney, Agent, or Firm*—Conley, Rose & Tayon, PC; Eric B. Meyertons

(57) ABSTRACT

System and method for locating and polishing a stain or protrusion on a surface. The stain or protrusion may be located by placing a plastic film between a portion of a human hand and the surface. The stain or protrusion may then be removed and/or polished by applying an applicator containing a plastic flexible tool to the stain or protrusion. The applicator may include a body made of flexible or compressible material having a cavity into which the plastic flexible tool is disposed.

392 Claims, 9 Drawing Sheets

OTHER PUBLICATIONS

International Preliminary Examination Report for Application No. PCT/US98/00540 mailed Apr. 16, 1999.
PCT International Search Report PCT/US 98/00540, dated Jun. 22, 1998.
English translation of Japanese Patent Application 4–11335 (Feb. 28, 1992).
English translation of Japanese Patent Application 1–97572 (Apr. 17, 1989).
Patent Abstracts of Japan, vol. 013, No. 310 (M–850), Jul. 14, 1989, & JP 01 097572 A (Tadao Koyakata), Apr. 17, 1989.
PCT International Search Report for PCT/US96/17416, dated Mar. 4, 1997.

Cryovac, "MPD 2055 Film," 2 pages (publication date is unknown but it is at least as early as Oct. 1995).

Videotape entitled "Auto Wax Company, Inc., Tip Tape Series 1, 1–14," Sep. 1991.

Videotape entitled Clay–Magic™ Demonstration (10:53)—No. 91333, © Auto Wax Company, Inc., 1994.

* cited by examiner

SURFACE POLISHING APPLICATOR SYSTEM AND METHOD

BACKGROUND OF THE INVENTION

1. Field of the Invention

The present invention relates to a method and system for use in removing and/or polishing a stain and/or protrusion from a surface, especially a surface of an automobile.

2. Brief Description of the Related Art

When rolling stocks (e.g., automobiles) are placed in parking lots near railways and iron works, or in places close to construction sites where a coating operation is conducted, iron powder and paint mist tend to gather on the coated surface of the rolling stocks and adhere thereto to form minute protrusions. Such unfavorable protrusions may be difficult to see with a human eye. Conventionally, such protrusions were removed by polishing the surface using a compound or a sand paper.

When a compound or sand paper is applied to a surface to remove protrusions, not only are the protrusions brought into contact with the abrasive, but the coated surface is brought into contact with the abrasive as well. Thus, scratches or flaws may be formed on the coated surface. As illustrated schematically in FIG. 3(*a*); it can be seen that this conventional method of polishing tends to suffer from poor operability, because the abrasive force tends to be fully exerted on the coated surface as well as the protrusions if and when the abrasive force is fully applied to the protrusions.

With a view toward ameliorating the poor operability of the conventional method, practitioners have previously proposed in U.S. Pat. No. 5,476,416, a plastic flexible tool including a plastic flexible material having mixed therewith fine abrasives such as silica sand and calcium carbonate. U.S. Pat. No. 5,476,416 matured from U.S. patent application Ser. No. 08/102,972 and is incorporated hereby by reference as if fully set forth herein.

As noted previously, some surface imperfections may be minute and/or "blend" with the surface in certain light. Thus, some stains and/or protrusions may be relatively difficult to see with a human eye. Since a plastic flexible tool tends to be selectively applied by a practitioner, the practitioner may not readily see a surface imperfection when applying the plastic flexible tool. Thus, some surface imperfections may not be treated by the practitioner with the plastic flexible tool. For instance, a practitioner may apply the plastic flexible tool to an automobile on a cloudy day and not treat surface imperfections which are more visible on a sunny day. Costly and/or tedious repeat treatments may be necessitated.

SUMMARY OF THE INVENTION

An advantage of the present invention is obtaining a relatively smooth and/or clean coated surface by polishing and/or removing a stain or protrusion from the surface. Accordingly, the present invention includes locating a stain or protrusion and then controlling both the polishing force being exerted to the protrusion or stain and the polishing force being applied to the planar surface.

A method of the invention may include:

covering at least a portion of a human hand with a plastic film;

determining the location of a stain or protrusion on the surface by touching the surface with at least a portion of the covered human hand, wherein plastic film is between the portion of the human hand and the surface while the surface is being touched;

applying a plastic flexible tool to the stain or protrusion, the plastic flexible tool including a plastic flexible material having an abrasive mixed therewith; and applying a force to the plastic flexible tool such that a polishing force is applied by the plastic flexible tool to the stain or protrusion on the surface.

One system of the invention may include:

a plastic film sized and adapted to cover at least a portion of a human hand, the plastic film having a thickness of between 0.1 mm and 0.75 mm; and a plastic flexible tool including a plastic flexible material having an abrasive mixed therewith.

The abrasive may include grains from about 3 to 50 $\mu$m in diameter.

The ability of the human hand to feel a stain or protrusion on the surface is enhanced by the plastic film If properly made and applied, the plastic film tends to exaggerate and accent the feel of such protrusions.

The vehicle may be an automobile, motorcycle, boat, truck, plane, or train. The surface may be coated or painted.

The plastic film is preferably substantially transparent. In this manner the practitioner can see the area in which poorly visible protrusions are located by feel. The plastic film may include a polyolefin, polystyrene, parafilm, and polyethylene. The plastic film may include elastomer material and/or an acrylic or methacrylic material.

The plastic film is preferably not too thin or too thick. If the film is too thin, then its strength and durability may be reduced If the film is too thick, then the sense of touch may be reduced. Preferably the plastic film is less than about 1.0 mm thick, more preferably between about 0.1 mm and less than about 0.75 mm thick, and more preferably still at a thickness of 0.5 mm. The plastic film is preferably sufficiently thin such that tactile sensitivity of the covered portion of the human hand to a surface protrusion is increased.

The plastic film preferably covers at least a portion of a human finger. The plastic film may be in the following shapes: flat and/or substantially planar, glove, mitten, envelope, sleeve, bowl, or finger cot.

One method may include checking the amount of removal of the stain or protrusion on the surface after the flexible plastic tool has been applied. The checking may be accomplished by touching at least a portion of a partially and/or totally covered human hand onto the surface, wherein plastic film is between the portion of the human hand and the surface while the surface is being touched.

One method may include pressing the plastic flexible tool against the surface, thereby deforming the plastic flexible tool to form a substantially flat surface on the plastic flexible tool. The plastic flexible tool may preferably be pressed against the surface such that the protrusion substantially embeds itself into the substantially flat surface of the plastic flexible tool. One preferred method includes reciprocating the substantially flat surface of the plastic flexible tool on the surface such that the protrusion protrudes into the plastic flexible tool and is brought into contact with abrasive inside the plastic flexible tool. Preferably the abrasive is substantially buried inside the plastic flexible tool such that the abrasive does not substantially protrude from the substantially flat surface of the plastic flexible tool.

Preferably the surface is not forcefully contacted with abrasive. Preferably the amount of force applied to the surface is about 1/30 to 1/200 (or, more preferably still, 1/80 to 1/100) of the amount of force applied to the protrusion. In one embodiment about 0.5 to 3.0 percent of force applied to the protrusion is substantially simultaneously applied to the surface.

A lubricant and/or water may be added to the surface such that the lubricant and/or water is between the plastic flexible tool and the surface while the plastic flexible tool is being applied to the surface.

Preferably the stain or protrusion is removed from the surface without substantially scratching the surface.

In an embodiment, an applicator is preferably used to guide the plastic flexible tool during polishing. The applicator may include a body having a top section and a bottom section. The bottom section preferably includes a substantially compressible material, and the top section may be constructed of a material that is more rigid than the compressible material of the bottom section. The top and bottom sections of the applicator may be secured together with glue or with a pressure-sensitive adhesive disposed between the sections.

A cavity for containing the plastic flexible tool is preferably formed in the bottom section. The cavity may have an inner surface that adheres to the plastic flexible tool to maintain it within the cavity while the applicator is reciprocated across a surface during polishing. The inner surface of the cavity may be formed by a lower portion of the top section of the body. The inner surface of the cavity may be serrated or contain convolutions to increase adhesion between the plastic flexible tool and the inner surface of the cavity.

The applicator body preferably includes a foam having between about 60 pores per inch and about 150 pores per inch. The top section may be constructed of a plastomer foam, while the bottom section may be constructed of an elastomer foam. The top section preferably contains a relatively rigid foam to facilitate grasping of the top section to handle the applicator. The top section may contain a closed cell foam or microcell foam. In one embodiment, the top section is made of a crosslinked polyethylene foam. In another embodiment, the top section is made of a metallocene polyolefin foam. The bottom section may be made of a urethane foam.

The body preferably contains a curved portion having an ergonomic shape to facilitate grasping of the body and to reduce the fatigue experienced by the user during polishing. The curved ergonomic portion may be sized to receive the thumb and/or fingers of a user.

Compressible material contained in the bottom section may act as a sponge to absorb and store a lubricating agent. The compressible material is preferably adapted to dispense a selected amount of stored liquid lubricating agent upon being compressed. The amount of liquid lubricating agent dispensed is preferably proportional to the degree to which the second compressible material is compressed during polishing. The top section of the applicator is preferably substantially impermeable to liquid lubricating agents to shield the user from such agents.

The applicator preferably has a density that allows it to float on water when the plastic flexible tool is disposed within the cavity.

The bottom section preferably includes a bottom surface about a perimeter of the cavity that contacts the surface when the applicator is reciprocated during polishing. The cavity preferably has a sufficient depth to contain the plastic flexible tool recessed within the cavity with respect to the bottom surface. The applicator body preferably covers at least about half of the surface area of the plastic flexible tool when it is disposed within the cavity. The bottom section may be compressed to cause the plastic flexible tool to become substantially flush with the bottom surface during use to allow the tool to contact the surface to be polished.

The tool may include a plurality of particles dispersed throughout the plastic flexible material that knead the plastic flexible material when the tool contacts the surface to be polished. The kneading of the plastic flexible material preferably causes plastic flexible material within the interior of the tool to become exposed on the outer surface of the tool. The particles dispersed throughout the plastic flexible material may be styrofoam beads.

The applicator of the present invention may be operated manually or used in combination with a mechanical polisher or sander that simulates a hand-polishing motion. The mechanical polisher may be a dual action polisher, an orbital polisher, or an oscillating polisher. The mechanical applicator may contain a body having a top portion and a bottom portion. The mechanical applicator may contain an opening in its top portion for engaging an alignment stud located on the mechanical polisher.

A hook-loop fastening system portion may be attached onto the inner surface of the cavity to provide a site for attachment to a complementary hook-loop fastening system mating surface located on the plastic flexible tool. The inner hook-loop fastening system portion disposed on the inner surface of the cavity preferably contains hook-type hook-loop fastening system for attachment to loop-type hook-loop fastening system contained on the mating surface of the polishing tool.

A hook-loop fastening system portion is preferably attached to the top portion of the mechanical applicator to connect the applicator to the mechanical polisher via a complementary hook-loop fastening system portion contained on the mechanical polisher. The hook-loop fastening system portion may be connected to the body by glue disposed between the hook-loop fastening system portion and the body that makes the body more rigid proximate its top section. The hook-loop fastening system portion of the mechanical applicator preferably includes "loop-type " hook-loop fastening system for attachment to "hook-type" hook-loop fastening system contained on the mating surface of the mechanical applicator.

DETAILED DESCRIPTION OF PREFERRED EMBODIMENTS

A method of the invention may include covering at least a portion of a human hand with a plastic film; determining the location of a stain or protrusion on the surface by touching the surface with at least a portion of the covered human hand, wherein plastic film is between the portion of the human hand and the surface while the surface is being touched; applying a plastic flexible tool to the stain or protrusion, the plastic flexible tool comprising a plastic flexible material having an abrasive mixed therewith; and applying a force to the plastic flexible tool such that a polishing force is applied by the plastic flexible tool to the stain or protrusion on the surface.

Figure 1:
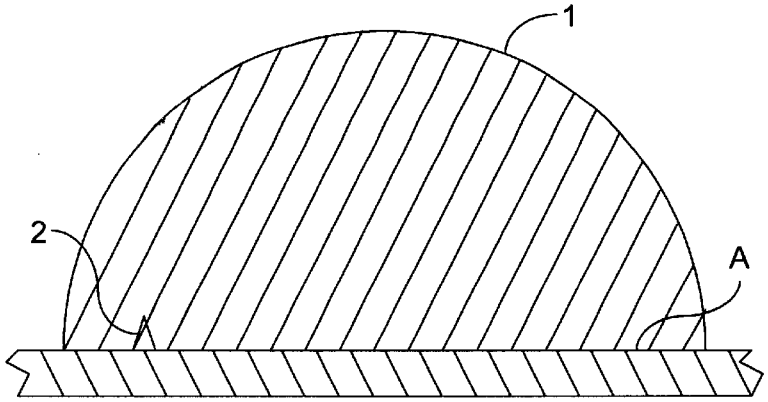
FIG. 1 is an explanatory figure showing a plastic flexible tool in use.
Figure 4:
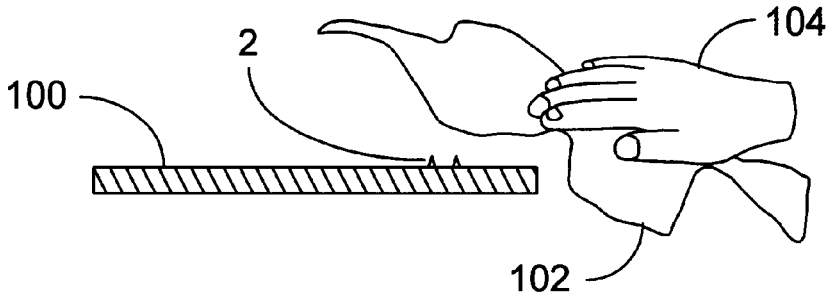
FIG. 4 depicts use of a plastic film.

FIG. 1 depicts a plastic flexible tool 1 applied to a surface with a protrusion 2. FIG. 4 depicts a surface 100 with a protrusion 2. In FIG. 4 a portion of the human hand 104 is covered by the plastic film 102 such that the plastic film 102 is between the human hand 104 and the surface 100.

Figure 5:
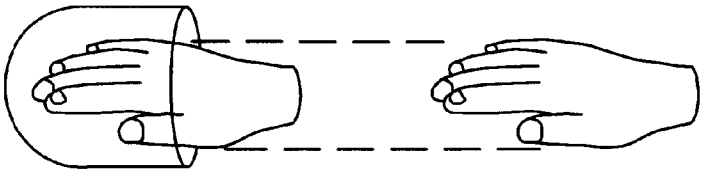
FIGS. 5–8 depict various embodiments of a plastic film.
Figure 6:
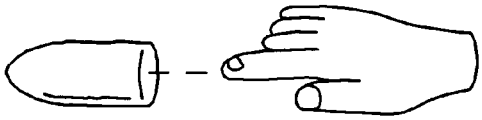
Figure 7:
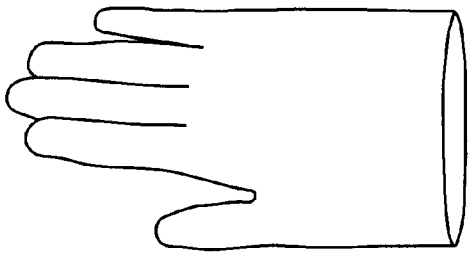
Figure 8:
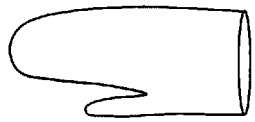

The plastic film preferably covers at least a portion of a human finger. In this context, "covers" means that the plastic film is between the surface to be touched and the portion of the human hand touching the surface. The plastic film may be in the following shapes: flat and/or substantially planar (see FIG. 4), glove (see FIG. 7), mitten (see FIG. 8), envelope, sleeve, or bowl (see FIG. 5), or finger cot (see FIG. 6).

Figure 9:
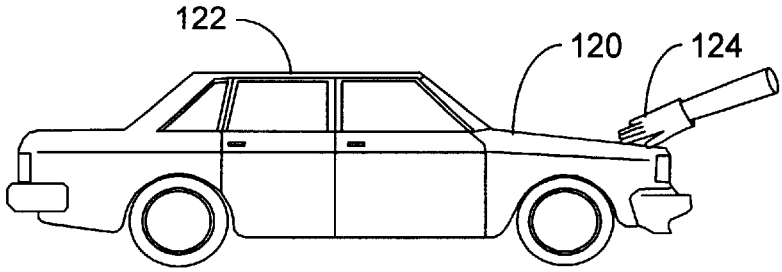
FIG. 9 depicts application of a plastic film onto an exterior surface of an automobile.

The vehicle may be an automobile, motorcycle, boat, truck, plane, or train. The surface may be coated or painted. FIG. 9 depicts an automobile 122 with a surface 120 being touched with a human hand within a glove 124.

The ability of the human hand to feel a stain or protrusion on the surface is enhanced by the plastic film. The plastic film tends to exaggerate and accent the sense of touch when feeling such stains or protrusions. It is believed that the ability of the plastic film to exaggerate and accent the sense of touch is a function of the thickness and modulus of elasticity for the film.

The plastic film is preferably not too thin or too thick. If the film is too thin, then its efficacy, strength and durability may be reduced. If the film is too thick, then the sense of touch may be reduced. Preferably the plastic film is less than about 1.0 mm thick, more preferably between about 0.1 mm and less than about 0.75 mm thick, and more preferably still at 0.5 mm thickness. The plastic film is preferably sufficiently thin such that tactile sensitivity of the covered portion of the human hand to a surface protrusion is increased.

The plastic film is also preferably not too elastic or inelastic. Preferably the plastic film has a modulus of elasticity according to ASTM test D-882, Method A, within the range of 50,000 to 120,000 psi at 73° F., and more preferably in the range of 60,000 to 100,000 psi at 73° F.

The plastic film is preferably substantially transparent. In this manner the practitioner can see the area in which poorly visible protrusions are located by feel. The plastic film may include a polyolefin, polystyrene, parafilm, and polyethylene. The plastic film may include elastomer material and/or an acrylic or methacrylic material.

In one embodiment, Cryovac MPD 2055 50 gauge Shrink Film (available from Innovative Packaging Inc. located in Grand Prairie, Texas, or Cryovac located in Iowa Park, Tex.) was used as the plastic film described above. In addition, Cryovac MPD 2100 50 gauge Shrink Film may also be used. Plastic film mittens that preferably have the following dimensions may be used: 4 and ¼" wide by 3", plus a ¼" lip on the edge of the mittens.

One method may include checking the amount of removal of the stain or protrusion on the surface after the flexible plastic tool has been applied. The checking may be accomplished by touching at least a portion of a covered human hand onto the surface, wherein plastic film is between the portion of the human hand and the surface while the surface is being touched.

One method may include pressing the plastic flexible tool against the surface, thereby deforming the plastic flexible tool to form a substantially flat surface on the plastic flexible tool. The plastic flexible tool may preferably be pressed against the surface such that the protrusion substantially embeds itself into the substantially flat surface of the plastic flexible tool. One preferred method includes reciprocating the substantially flat surface of the plastic flexible tool on the surface such that the protrusion protrudes into the plastic flexible tool and is brought into contact with abrasive inside the plastic flexible tool. Preferably the abrasive is substantially buried inside the plastic flexible tool such that the abrasive does not substantially protrude from the substantially flat surface of the plastic flexible tool.

Preferably the surface is not forcefully contacted with abrasive. Preferably the amount of force applied to the surface is about 1/30 to 1/200 (or, more preferably still, 1/80 to 1/100) of the amount of force applied to the protrusion. In one embodiment about 0.5 to 3.0 percent of force applied to the protrusion is substantially simultaneously applied to the surface.

A lubricant and/or water may be added to the surface such that the lubricant and/or water is between the plastic flexible tool and the surface while the plastic flexible tool is being applied to the surface. The lubricant may include Clay Magic #49 Body Shine (Auto Wax Company, Inc., Dallas, Tex.).

Preferably the stain or protrusion is removed from the surface without substantially scratching the surface.

The plastic flexible tool is preferably made by substantially homogeneously mixing the abrasive with a plastic flexible material.

Figure 10A:
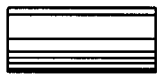
FIGS. 10A–10F depict various shapes of a plastic flexible tool.
Figure 10B:
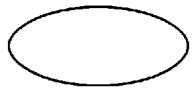
Figure 10C:
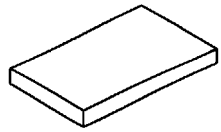
Figure 10D:
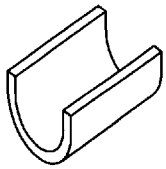
Figure 10E:
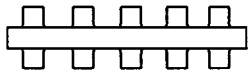
Figure 10F:
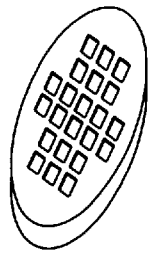

FIGS. 10A–10F depict various shapes in which the plastic flexible tool may be formed. For example, the flexible tool may be in the shape of a bar (FIG. 10A), an oval (FIG. 10B), a flat plane (FIG. 10C), a bent plane (FIG. 10D), a flat plane with raised portions (FIG. 10E), or a "waffle" (FIG. 10F). The plastic flexible tool may become contaminated with dirt during use. Some of the above-referenced shapes tend to maximize the amount of clean surface area available for a certain tool volume.

A plastic flexible tool may be produced by mixing 100 parts by weight of a petroleum resin (e.g., polybutene) as a plastic flexible material with 65 parts by weight of fine silica sand and calcium carbonate grains from 20 to 30 $\mu$m in diameter, and, optionally, 5 parts by weight of a powder synthetic detergent composed of grains 500 $\mu$m in diameter.

Figure 2:
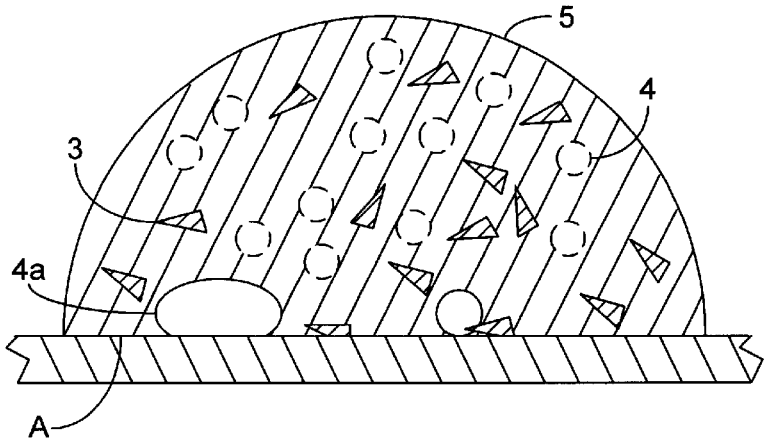
FIG. 2 is a cross sectional view of a plastic flexible tool with the abrasive thereof forming protrusions against the polishing surface.

Referring to FIG. 1, the flexible tool 1 above may be used for removing a small protrusion 2 (e.g., a protrusion 0.5 mm in height and 1 mm in width) from the coated planar surface A. First, the protrusion may be located and/or detected by touching the surface with a portion of a human hand covered with a plastic film. Once the protrusion is located, the flexible tool may be pressed against coated planar surface A to form a flat plane on the flexible tool. Fine abrasive 3 and, optionally, powder synthetic detergent 4 may be distributed within a flexible material 5 as shown in FIG. 2. By reciprocating the planar surface of the flexible tool 1 on the coated planar surface A having the protrusion 2 thereon, the protrusion 2 may be removed completely from the coated planar surface A in a relatively small time period (e.g., about 30 seconds). A stain on the coated planar surface may be removed at the same time. A coated surface as plain and smooth as the surface before polishing may be obtained free from scratches and flaws by the polishing operation.

Referring again to FIG. 2, in one embodiment a pore 4*a* can be seen to open on the surface in contact with the coated planar surface A, due to the dissolution of the powder synthetic detergent 4. The open pore 4*a* tends to facilitate sticking of the fine abrasive against the polishing surface. In this manner, the polishing speed of the planar surface may be accelerated.

Hard fine grains such as alumina, ceramics, and/or Green Carborundum may be incorporated in the flexible material as the fine abrasive 3. These grains may be in addition to or replace the aforementioned grains of silica sand and calcium carbonate. Any of the above-mentioned abrasives may be used either alone or as a mixture of two or more selected therefrom. The fine abrasive grains are preferably confined to a diameter in the range of 20 to 30 $\mu$m, but the size may also be within a range of from about 3 to about 50 $\mu$m depending on the object of polishing. The amount of fine abrasive may be varied within a range of from about 60 to 80 parts by weight with respect to 100 parts weight of plastic flexible material.

In removing small protrusions from the coated surface using the plastic flexible tool according to the present invention, the plastic flexible tool is preferably pressed against a flat and hard plane to form a flat surface on the plastic flexible tool. At this stage, the fine abrasive may be buried inside the flat surface of the plastic flexible tool to leave no edges thereof sticking out from the flat surface of the plastic flexible tool.

When the flat surface of the plastic flexible tool is placed over a small protrusion on the coated surface, the small protrusion tends to bore a small hole on the flat surface of the plastic flexible tool and accommodate itself therein. This tendency is illustrated in FIG. 1. When the flexible tool is repeatedly reciprocated on the coated surface along the direction indicated by the arrows shown in FIG. 1, the flat surface of the plastic flexible tool moves with its surface being cut with the small protrusion. Since the fine abrasive is not pressed uniformly by the small protrusion, the edges of the fine abrasive stick out from the flexible material.

Accordingly, the fine abrasive sticking out from the flexible material may be brought forcibly into contact with the small protrusion to conduct polishing. The flat surface formed on the flexible tool is also brought into contact with the coated surface in this case, however, the coated surface suffers little or no scratches or flaws because the edges of the fine abrasive do not stick out from the flat surface of the flexible material.

Figure 3A:
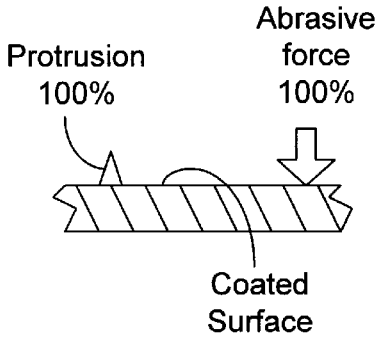
FIG. 3 is a schematic figure provided as an explanatory means to show the exertion of polishing force against the protrusions and stain.
Figure 3B:
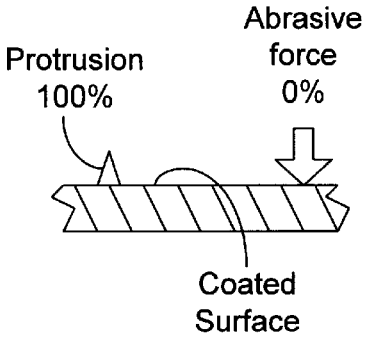
Figure 3C:
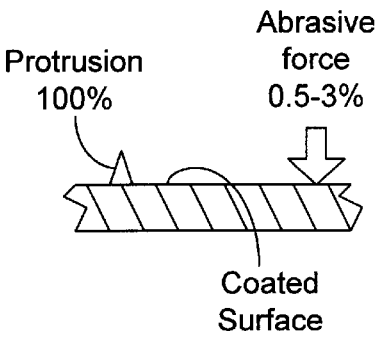

Water may be sprayed to the region on which the flexible tool is moved or to the flexible tool. The powder detergent, if any, incorporated into the flexible tool may then dissolve into the water to allow the fine abrasive to be exposed on the surface. The amount of the exposed fine abrasive can be controlled by the amount of powder detergent being incorporated into the flexible tool. The fine abrasive grains sticking out from the polishing surface immediately slip into the flexible material upon detection of a resistance on the polishing surface. In this manner, the polishing force against the flat surface may be about 1/80 to 1/100 of the force applied to a protrusion. Force is thus applied to both the protrusion and the surface stain when polishing is conducted as shown in FIG. 3(*c*). Specifically, about 0.5 to 3% of a polishing force may be applied to the stain with respect to 100% of the force applied to the protrusion.

The polishing ability against a flat surface may be controlled in the range of from 1/30 to 1/200 of the force applied to a protrusion.

In removing both the protrusion and the stain from a coated surface, it is preferred that the protrusion and the stain are removed within a same duration of time, or the protrusion is removed faster than the stain. It is not desirable to have the stain be removed faster than the protrusion, because the polishing marks of the protrusion may remain on the coated surface.

The plastic flexible tool according to the present invention may include a flexible material having mixed therewith fine abrasive and powder synthetic detergent. Accordingly, the flexible tool according to the present invention is capable of removing small protrusions and stains from the surface without impairing a flat or curved plane of a coated surface. This removal is accomplished by maintaining a uniform surface against the area to be polished. Furthermore, the plastic flexible tool tends to facilitate rapid operation because it can be worked with a small frictional force. A plastic flexible tool may be available from Auto Wax Company, Inc. (Dallas, Tex.), Joybond Co., Inc. (Tokyo, Japan), Auto Chemie Co., Ltd. (Tokyo, Japan), Honda Motor Co. (Tokyo, Japan) or Nissan Motor Co. (Tokyo, Japan). Auto Wax Company, Inc. sells a plastic flexible tool under the "Clay Magica" tradename.

Further Improvements

Figure 11:
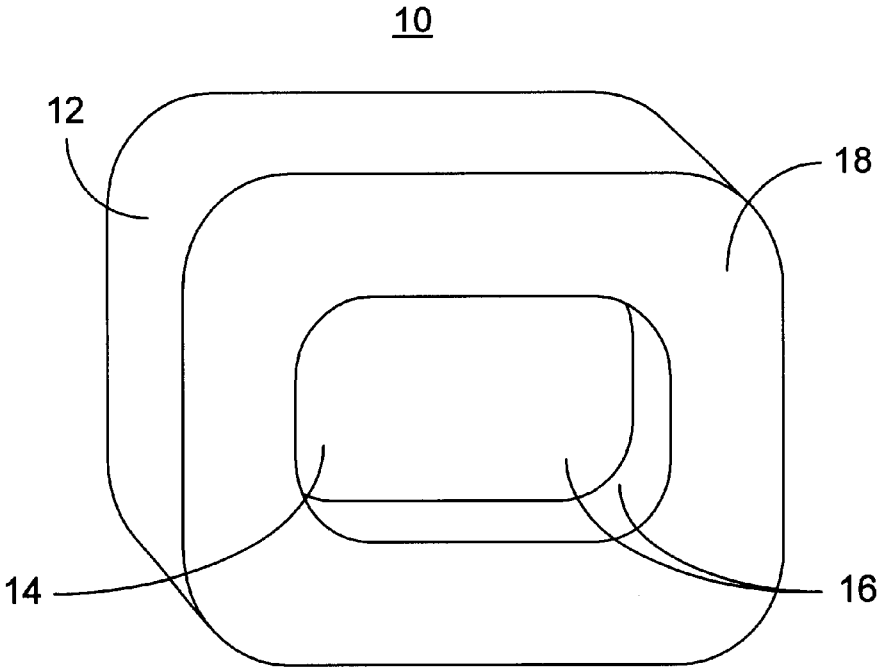
FIG. 11 depicts a bottom perspective view of an applicator constructed in accordance with the present invention.

The plastic flexible tool may be disposed within or onto an applicator to facilitate the exertion of a polishing force by the tool onto a surface. A bottom perspective view of an applicator 10 is depicted in FIG. 11. The applicator preferably includes a body 12 having a cavity 14 formed therein. The plastic flexible tool is preferably housed within the cavity. The cavity is preferably defined by an inner surface 16. The body is preferably made of a flexible or compressible material such as a foam. Although the body as depicted in FIG. 11 has an oval shape, it is to be understood that the body may be of a number of other shapes including circular, rectangular, etc. Force may be applied to the applicator to move the applicator and plastic flexible tool disposed within the applicator across a surface to be polished, thereby causing the plastic flexible tool to exert a polishing force on the surface.

Figure 17A:
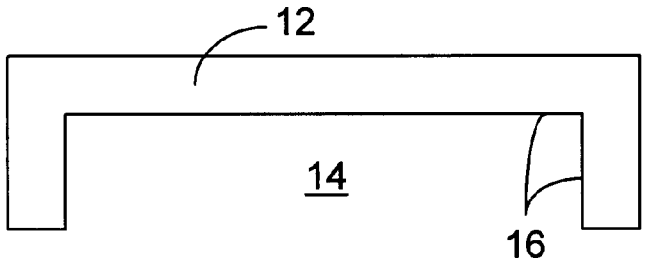
FIGS. 17A–17D depict various embodiments of an applicator cavity.
Figure 17B:
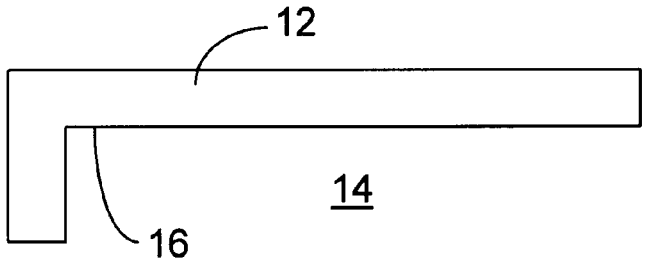
Figure 17C:
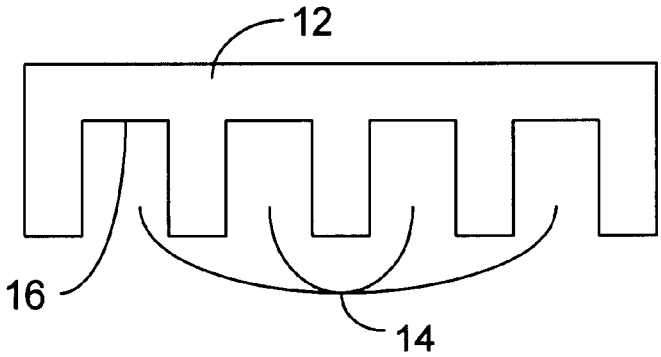
Figure 17D:
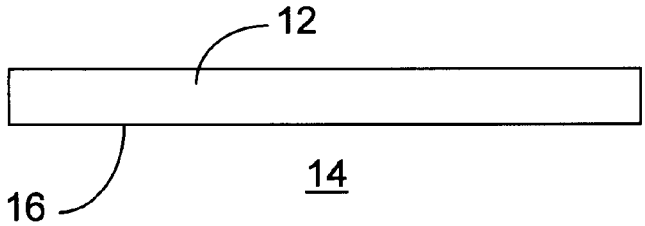

For the purpose of this description, "cavity" is taken to mean a site proximate the body of the applicator where the plastic flexible tool is disposed. The cavity 14 may be a region indented into body 12 that is partially enclosed by the body as depicted in FIG. 17A and FIG. 17B. As depicted in FIG. 17C, the cavity may include more than one indention within which at least a portion of the plastic flexible tool is disposed. It is also to be understood that cavity 14 may be a substantially unenclosed region of space proximate the bottom of the applicator body. A cavity formed on the planar surface of the applicator is depicted in FIG. 17D. The cavity 14 in FIG. 17D may be altered during polishing when the plastic flexible tool exerts a force against the body, thereby deforming the body and embedding itself into inner surface 16. Alternately, the inner surface 16 may be sufficiently rigid so as to remain substantially undeformed during polishing such that the entire tool protrudes from the body. It is generally preferred, however that at least a portion of the plastic flexible tool be recessed within the body to maintain the tool within cavity 14.

Figure 14:
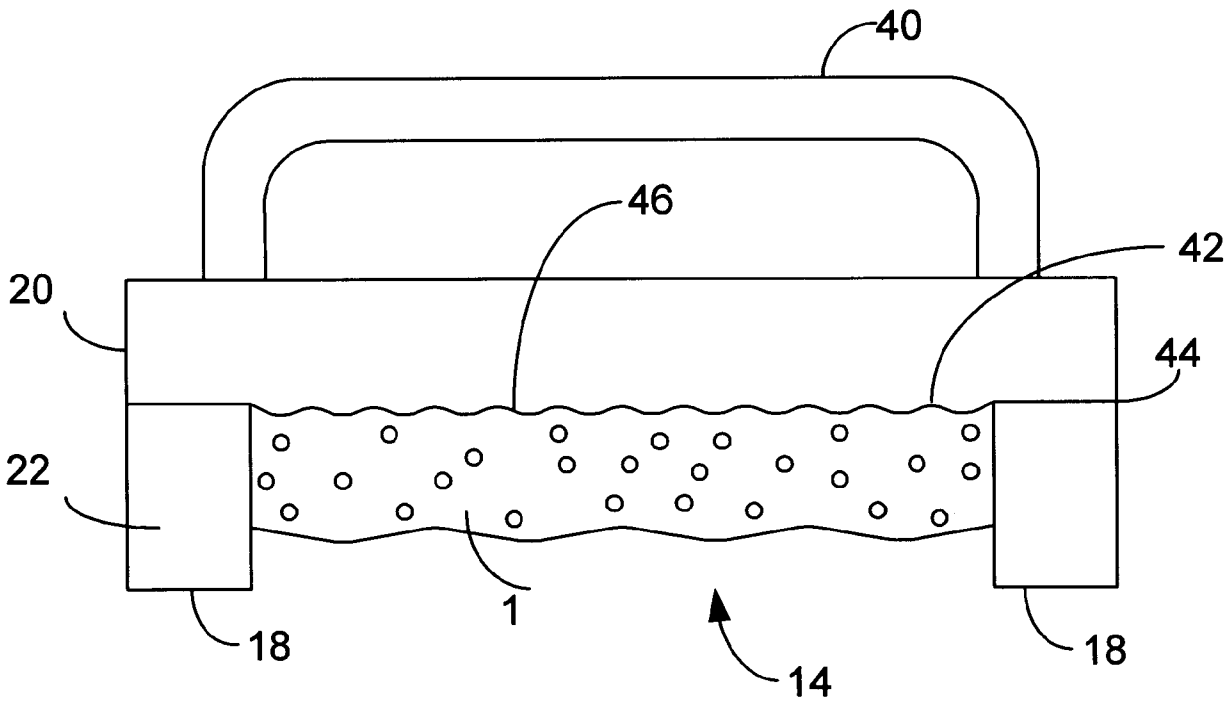
FIG. 14 depicts a cross sectional view of an applicator having a plastic flexible tool disposed within its cavity.

The applicator 10 is preferably attachable to the plastic flexible tool to form a fixable engagement. The plastic flexible tool may adhere to the inner surface of the cavity. The inner surface may be serrated and/or contain convolutions 42 (as shown in FIG. 14) to increase adhesion between the inner surface and the plastic flexible tool. The adhesion between the inner surface and the plastic flexible tool is preferably sufficient to maintain a fixable engagement between the tool and the inner surface when the tool and applicator are reciprocated across a surface to polish it. The inner surface of the cavity is preferably characterized by an adhesivity or "stickiness" that causes it to adhere to the plastic flexible tool. Alternately, the inner surface of the cavity may be coated with an adhesive that allows the plastic flexible tool to be removably attached to the inner surface. The plastic flexible tool is preferably able to be repeatedly inserted into and removed from the cavity without a substantial lessening of adhesive strength between the tool and the inner surface. In an alternate embodiment, the plastic flexible tool may be glued to the inner surface. It is generally preferred, however that the plastic flexible tool be removably engaged with the applicator.

In an alternate embodiment, the inner surface 16 contains a hook-loop fastening system portion 31 (shown in FIG. 13) for attachment to a complementary hook-loop fastening system mating surface located on the plastic flexible tool. In this manner, the plastic flexible tool may be easily removed and replaced if it becomes excessively dirty or aged. The hook-loop fastening system portion may be attached to the inner surface by a glue or a pressure-sensitive adhesive. The hook-loop fastening system portion on the inner surface preferably contains "hook-type" hook-loop fastening system for attachment to "loop-type" hook-loop fastening system contained on the mating surface of the plastic flexible tool. "Hook-type" hook-loop fastening system is taken to mean an aggressive hook-loop fastening system mating section having relatively large attachment elements (i.e., hooks) as compared to those attachment elements (i.e., loops) of a complementary "loop-type" hook-loop fastening system section.

Figure 12:
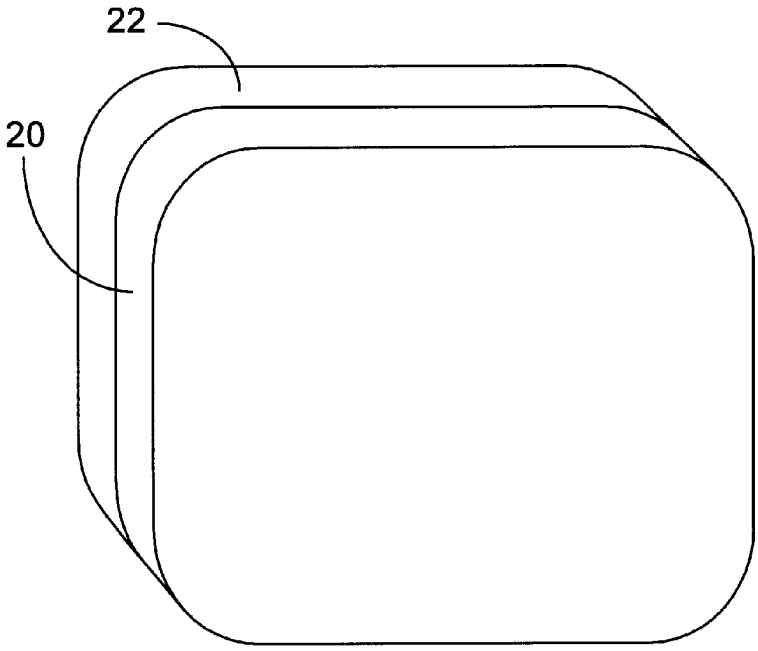
FIG. 12 depicts a top perspective view of an applicator constructed in accordance with the present invention.

A perspective top view of the applicator is depicted in FIG. 12. In an embodiment of the invention, the body comprises a top section 20 and a bottom section 22. The top and bottom sections may be glued together or connected via a pressure-sensitive adhesive. The bottom section is preferably made of compressible or flexible material, and the top and bottom sections may have different compressibilities and/or flexibilities. The top section is preferably more rigid and/or less compressible than the bottom section. It is to be understood that the top section may be substantially compressible and/or flexible, however it is generally preferred that it be at least slightly more rigid than the bottom section. Alternately, the top section may be constructed of a substantially rigid material such as a plastic. The bottom section may have a thickness that is greater than that of the top section.

In an embodiment, the top section of the applicator is made of a plastomer and the bottom section is made of an elastomer. The plastomer may be manufactured from a resin having a specific gravity of at least about 0.89, whereas the elastomer may be manufactured from a resin having a specific gravity of less than about 0.89. The elastomer tends to be relatively soft and more capable of stretching as compared to the plastomer.

The top section is preferably made of a relatively rigid microcell foam or closed-cell foam, while the bottom section is preferably made of an open cell foam. In one embodiment, the top section contains a polyethylene foam (preferably. crosslinked) or another polyolefin foam (preferably formed with a metahocene catalyst). It has been found that a top section constructed of foam MC SSP-20-NE or foam MC 1900-EVA, each of which is commercially available from Foam Fabricators, Ltd. located in Dallas, Tex., performs adequately in the applicator of the present invention. The top section may have a density of about 1.6 to 2 pounds per cubic foot. It has also been found that 100-30 urethane, also commercially available from Foam Fabricators, Ltd. of Dallas, Tex., performs adequately as a material of construction of the bottom section of the applicator.

The material of construction and rigidity of the bottom section of the applicator should be chosen according to the surface to be polished. The pores per inch of a given foam may be used as an indicator of the "aggressiveness" of the foam. More aggressive foams (i.e., those having a relatively low number of pores per inch) tend to be more suitable for polishing surfaces that can withstand or require relatively harsh treatment. Generally, the bottom section should contain a less aggressive foam having a relatively high number of pores per inch when a newly painted surface is to be polished. Foams having a relatively high number of pores per inch also generally tend to absorb liquid lubricating agents more readily than foams having fewer pores per inch, other things being equal. The bottom section is preferably made of a foam having between about 60 pores per inch and about 150 pores per inch, more preferably between about 75 pores per inch and about 125 pores per inch, and more preferably still between about 90 pores per inch and about 110 pores per inch.

The top section is preferably relatively rigid to facilitate grasping and handling of the applicator. The bottom section is preferably relatively compressible to allow the depth of cavity 14 to be altered during use. The thickness of the plastic flexible tool is preferably less than the depth of the cavity, and the plastic flexible tool is preferably disposed within the cavity such that the tool is recessed within the cavity with respect to the bottom surface 18. With the tool recessed within the cavity, the applicator could be set on a surface whereby the bottom surface 18 engages the surface without contact occurring between the plastic flexible tool and the surface. In this manner, contact between a surface and the plastic flexible tool when the tool is not in use may be avoided. Such contact could contaminate the plastic flexible tool or allow sticking between the surface and the tool. The bottom section may be compressed by the application of a force to the top section, causing a decrease in the depth of the cavity such that the plastic flexible tool becomes flush with or extends beyond the bottom surface 18 to allow contact between the tool and the surface to be polished.

The bottom surface 18 preferably engages the surface that is polished during use and preferably is sufficiently soft so as not to mark or scratch the surface during reciprocation of the applicator across the surface.

In an embodiment, the bottom section absorbs a lubricant agent or water and selectively disperses the lubricating agent or water to the surface to be polished. The lubricating agent or water may be applied to the surface or directly to the applicator. The bottom surface preferably acts as a sponge to store and dispense lubricating agent or water during polishing. Compressing the bottom surface of the applicator to a selected degree preferably causes the dispersal of a selected amount of lubricating agent or water from the applicator. The top section is preferably impermeable to lubricating agents and/or water to inhibit such agents from passing through the applicator and contacting the user.

Figure 13:
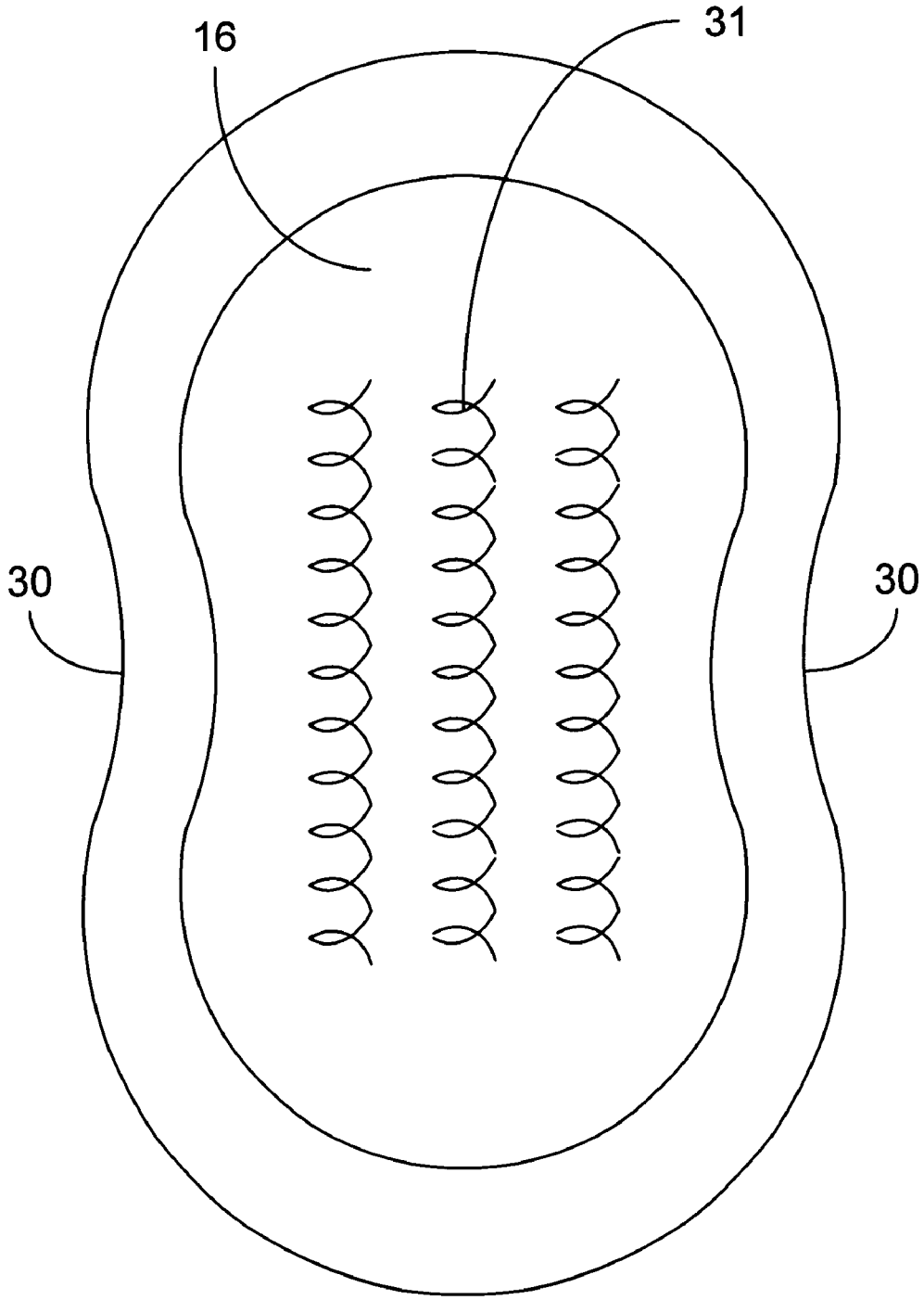
FIG. 13 depicts a bottom view of an ergonomically-shaped applicator constructed in accordance with the present invention.

In an embodiment depicted in FIG. 13, the body contains an ergonomic curved portion 30 to facilitate grasping of the applicator. The curved portion is preferably grasped by the fingers and/or thumb during use. The ergonomic shape of the applicator tends to reduce the fatigue experienced by the user when manually polishing a surface for an extended period of time.

A cross-sectional view taken from the side of an applicator having a plastic flexible tool 1 disposed within cavity 14 is illustrated in FIG. 14. The plastic flexible tool may have a consistency similar to that of clay such that the tool is deformable to assume the shape of the cavity. The lower surface 46 of the top section that contacts bottom section 22 at interface 44 may form a portion of the inner surface of the cavity. The plastic flexible tool is preferably shaped to substantially cover lower surface 46 of the top section. Applicator 10 may contain a handle 40 which may be grasped during polishing to direct the applicator.

The applicator and plastic flexible tool may be used to polish the surface of a vehicle such as a boat. The applicator preferably has a density that enables it and the plastic flexible tool disposed within its cavity to float on water in case that the applicator is accidentally dropped into water during use. The applicator body also preferably covers at least about half of the surface area (e.g., one side of a planar plastic flexible tool) of the plastic flexible tool when the tool is disposed within the cavity during use. In this manner, the likelihood that the plastic flexible tool will be contaminated if the applicator and tool are dropped is reduced.

Applicator 10 may be used in combination with the previously described embodiments. In particular, plastic film 102 may be placed onto a user's hand and used to locate a stain or protrusion or check the amount of stain or protrusion on the surface in the manner described above. The plastic flexible tool may be disposed within the cavity. The applicator is preferably pressed against the surface, causing bottom section 22 to compress and the surface of the plastic flexible tool to become flush with bottom surface 18. The plastic flexible tool preferably engages the surface to form a substantially flat surface on the tool. A force is preferably applied to the applicator to move it, causing the plastic flexible tool to move along the surface while exerting a polishing force on the surface. The applicator is preferably reciprocated across the stain or protrusion until the stain or protrusion is removed.

The applicator may be manually operated in the hand of a user, or alternately may be connected to a mechanical polisher. The mechanical polisher may be a dual action polisher, an orbital polisher, an oscillating polisher, or any other automatic polisher adapted to simulate the motion that characterizes manual polishing. In this description, "polisher" is taken to also include a sander or drill. For instance, the applicator may be fitted onto a sander or drill that serves as a polishing device. An exemplary polisher that has been found to perform adequately in embodiments of the invention is the model 6102 polisher, commercially available from Black & Decker Corp. of Towson, Md.

Figure 15A:
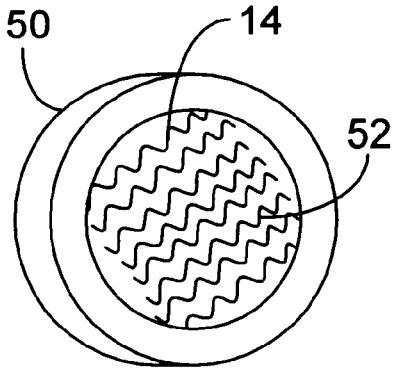
FIGS. 15A–15C depict top and bottom views of an applicator adapted for use with a mechanical polisher and a plastic flexible tool containing a hook-loop fastening system mating surface.
Figure 15B:
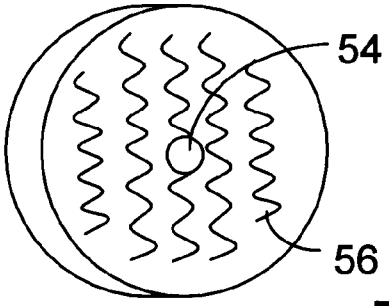

FIG. 15 depicts a mechanical applicator 50 for mechanically polishing a surface. Bottom and top views of applicator 50 are depicted in FIG. 15A and FIG. 15B, respectively. Mechanical applicator 50 may contain any of the features described above in connection with applicator 10.

Figure 15C:
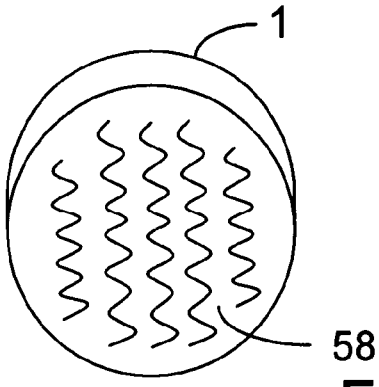

In particular, applicator 50 preferably contains a cavity 14 formed into its bottom surface for accepting flexible plastic tool 1. The cavity may have a depth that is less than or equal to the thickness of the plastic flexible tool, causing the tool to protrude from or be flush with the bottom surface of the applicator. As shown in FIG. 15C, flexible plastic tool 1 may contain hook-loop fastening system portion 58 for attachment to hook-loop fastening system portion 52, which is disposed on the inner surface of cavity 14. The flexible plastic tool is preferably substantially planar, and hook-loop fastening system portion 58 may substantially cover a side of the tool.

The applicator preferably contains a connecting portion on its top surface for attachment to a mechanical applicator. In an embodiment, the connecting portion is a hook-loop fastening system portion 56 for connecting the body to a complementary, hook-loop fastening system mating surface on the mechanical polisher. The hook-loop fastening system portion 56 preferably includes "loop-type" hook-loop fastening system for attaching to "hook-type hook-loop fastening system" contained on the mating surface of the mechanical applicator.

Hook-loop fastening system portion 56 may be attached to the body of applicator 50 using glue or a pressure-sensitive adhesive disposed between the hook-loop fastening system portion and the body. The attachment element (e.g., glue, pressure-sensitive adhesive) may cause the top surface of the applicator to become relatively rigid.

Figure 16:
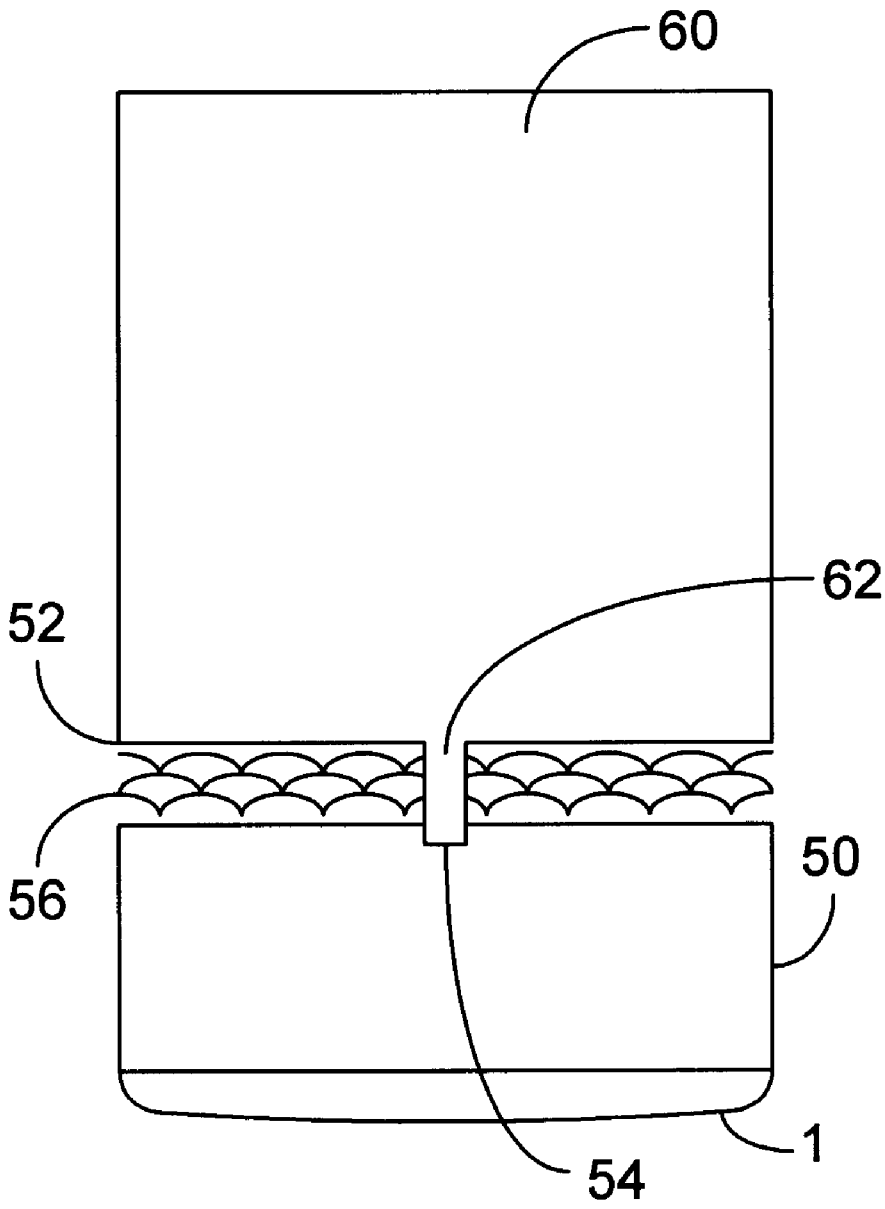
FIG. 16 depicts an applicator secured to a mechanical polisher.

The body of applicator 50 preferably has the shape of a substantially circular disk, and cavity 14 is preferably substantially circular as well. It is to be appreciated that the body may have a variety of shapes depending upon the shape of the mating surface contained on the mechanical polisher. FIG. 16 illustrates the connection of applicator 50 and mechanical polisher 60. The applicator may contain opening 54 in the top portion for engaging a protrusion on the mechanical polisher. The mechanical polisher may contain an alignment stud 62 for insertion into opening 54 to allow the applicator and polisher to be properly connected and centered.

In an embodiment, the plastic flexible tool contains a plurality of particles 48 (as shown in FIG. 14) or beads dispersed throughout the plastic flexible material. The beads are preferably relatively small (e.g., about the size of the head of a pin or less) and may have a number of shapes including a spherical or cubic shape. The particles preferably knead the plastic flexible material to "clean it" when the material is in contact with the surface to be polished. The kneading of the plastic flexible material preferably causes material located within the interior of the tool to become exposed on the outer surface of the tool, and moves material exposed on the outer surface of the tool to the interior of the tool. In this manner, the plastic flexible material may be redistributed about the tool to increase the life of the tool by exposing "fresh" plastic material for contacting the surface. Styrofoam particles have been found to adequately knead the plastic flexible material, however it is to be understood that particles or beads constructed of other materials may be used. The particles may be plastic and are preferably elastomers (e.g., foam). The particles preferably remain embedded within the plastic flexible material during use and do not scratch or mark the surface that is being polished.

The applicator of the present invention preferably provides an ergonomic body to reduce fatigue experienced by the user when grasping the applicator during polishing. In addition, the applicator preferably inhibits contact between the user and the plastic flexible tool during use. The applicator also may increase the rate at which a surface is polished by (a) providing a rigid body to be grasped by the user and (b) increasing the surface area of the plastic flexible tool that engages the surface during polishing. For instance, in the absence of an applicator a planar plastic flexible tool typically must be grasped on each of its sides, thereby reducing the total surface area of the plastic flexible tool available for contacting the vehicle. Use of the applicator allows an entire side of the plastic flexible tool to engage the surface during polishing. Moreover, the applicator may be used to store a lubricating agent and selectively dispense the lubricating agent onto a surface while it is polished. The applicator preferably shields the user from contact with the lubricating agent The applicator may be used manually or adapted for use with mechanical polishers.

Further modifications and alternative embodiments of various aspects of the invention will be apparent to those skilled in the art in view of this description. Accordingly, this description is to be construed as illustrative only and is for the purpose of teaching those skilled in the art the general manner of carrying out the invention. It is to be understood that the forms of the invention shown and described herein are to be taken as the presently preferred embodiments. Elements and materials may be substituted for those illustrated and described herein, parts and processes may be reversed, and certain features of the invention may be utilized independently, all as would be apparent to one skilled in the art after having the benefit of this description of the invention. Changes may be made in the elements described herein without departing from the spirit and scope of the invention as described in the following claims.

What is claimed is:

1. An applicator for polishing a stain or protrusion from a surface, comprising a body, a cavity, and a hook-loop fastening system portion connected to the inner surface, the hook-loop fastening system portion being adapted to form a fixable engagement with a hook-loop fastening system mating surface of a plastic flexible tool during use, the body comprising a top section and a bottom section, the top section comprising a first material, the bottom section comprising a second compressible material, the first material being more rigid than the second compressible material, the cavity being formed on the bottom section and comprising an inner surface, the inner surface comprising convolutions to facilitate adhesion between the plastic flexible tool and the inner surface of the cavity during use.

2. The applicator of claim 1 wherein the body comprises a curved portion having an ergonomic shape to facilitate grasping of the body.

3. The applicator of claim 1 wherein at least a portion of the inner surface of the cavity is definge by a lower portion of the top section.

4. The applicator of claim 1 wherein the bottom section is adapted to absorb a lubricating agent during use.

5. The applicator of claim 1 wherein the bottom section comprises a foam having between about 60 pores per square inch and about 150 pores per square inch.

6. The applicator of claim 1 wherein the second compressible material can absorb liquid lubricating agent during use, the second compressible material being adapted to dispense an amount of liquid lubricating agent upon being compressed, and wherein the amount of liquid lubricating agent dispensed varies as a function of a degree to which the second compressible material is compressed.

7. An applicator for polishing a stain or protrusion from a surface, comprising a body and a cavity, the body comprising a top section and a bottom section, the top section comprising a first material, the bottom section comprising a second compressible material, the first material being more rigid than the second compressible material, the cavity being formed on the bottom section and comprising an inner surface, the inner surface being adapted to fixably adhere to a plastic flexible tool during use, the inner surface comprising convolutions to facilitate adhesion between the plastic flexible tool and the inner surface.

8. An applicator for polishing a stain or protrusion from a surface, comprising a body and a cavity, the body comprising a top section and a bottom section, the top section comprising a first material, the bottom section comprising a second compressible material, the first material being more rigid than the second compressible material, the cavity being formed on the bottom section and comprising an inner surface, the inner surface being adapted to fixably adhere to a plastic flexible tool during use, the inner surface being serrated to facilitate adhesion between the plastic flexible tool and the inner surface.

9. The applicator of claim 1 wherein the applicator has a density that causes the applicator to float on water.

10. The applicator of claim 1 wherein the top section is substantially impermeable to liquid lubricating agents.

11. The applicator of claim 1 wherein the body comprises foam for storing a lubricating agent and dispensing the lubricating agent to the surface during use.

12. The applicator of claim 1 wherein the plastic flexible tool is positionable within the cavity during use such that the body covers at least about half of a surface area of the plastic flexible tool.

13. The applicator of claim 1, further comprising a hook-loop fastening system portion on the inner surface for forming a fixable engagement with a mating surface of the plastic flexible tool during use.

14. The applicator of claim 1 wherein the bottom section comprises a bottom surface located about a perimeter of the cavity, and wherein the cavity is adapted to contain the plastic flexible tool such that the tool is recessed within the cavity with respect to the bottom surface during use.

15. The applicator of claim 1 wherein the bottom section comprises a bottom surface about a perimeter of the cavity, and wherein the cavity is adapted to contain the plastic flexible tool such that the tool is recessed within the cavity with respect to the bottom surface, and wherein the bottom section is compressible to cause the plastic flexible tool to become substantially flush with the bottom surface during use.

16. The applicator of claim 1, further comprising a pressure-sensitive adhesive connecting the top section and the bottom section together.

17. The applicator of claim 1, further comprising a glue disposed between the top section and the bottom section.

18. The applicator of claim 1 wherein the first material is a plastomer foam and the second compressible material is an elastomer foam.

19. The applicator of claim 1 wherein the first material is a crosslinked polyethylene foam, and wherein the second compressible material is a urethane foam.

20. The applicator of claim 1 wherein the first material is a closed-cell metallocene polyolefin foam, and wherein the second compressible material is a urethane foam.

21. A system for polishing a surface, comprising:

a tool comprising a plastic flexible material having mixed therewith an abrasive comprising grains from about 3 μm to 50 μm in diameter;

an applicator for guiding the tool, the applicator comprising a body and a cavity having an inner surface, at least a portion of the body being substantially compressible;

a plastic film for locating a stain or protrusion on the surface, the plastic film being sized to cover at least a portion of a human hand, the plastic film having a thickness between about 0.1 mm and about 0.75 mm; and a hook-loop fastening system portion connected to the inner surface, the hook-loop fastening system portion being adapted to form a fixable engagement with a hook-loop fastening system mating surface of the plastic flexible tool during use;

and wherein the tool is adapted to be contained within the cavity whereby the inner surface fixably adheres to the tool.

22. An applicator for polishing a stain or protrusion from a surface, comprising a body and a cavity, the body comprising a top section and a bottom section, the top section comprising a first material, the bottom section comprising a second compressible material, the first material being more rigid than the second compressible material, the cavity being formed on the bottom section and comprising an inner surface, the inner surface being adapted to fixably adhere to a plastic flexible tool during use, wherein the first material is a closed-cell metallocene polyolefin foam, and wherein the second compressible material is a urethane foam.

23. A system for polishing a surface, comprising:

a tool comprising a plastic flexible material having mixed therewith an abrasive;

an applicator for guiding the tool, the applicator comprising a body and a cavity having an inner surface, at least a portion of the body being substantially compressible;

a plastic film for locating a stain or protrusion on the surface, the plastic film being sized to cover at least a portion of a human hand, the plastic film having a thickness between about 0.1 mm and about 0.75 mm;

and wherein the tool is adapted to be contained within the cavity whereby the inner surface fixably adheres to the tool.

24. The system of claim 21 wherein the body comprises a top section and a bottom section, the top section comprising a first compressible material, the bottom section comprising a second compressible material, the first compressible material being more rigid than the second compressible material, and wherein the cavity is formed into the bottom section.

25. The system of claim 21 wherein the body comprises a curve to facilitate grasping of the body.

26. The system of claim 21 wherein the body comprises a top section and a bottom section, the top section comprising a first compressible material, the bottom section comprising a second compressible material, the first compressible material being more rigid than the second compressible material, and wherein the cavity is formed into the bottom section, and wherein the inner surface of the cavity comprises a lower portion of the top section.

27. The system of claim 21 wherein at least a portion of the body is adapted to absorb a lubricating agent during use.

28. The system of claim 21 wherein the body comprises a foam having between about 60 pores per square inch and about 150 pores per square inch.

29. The system of claim 21 wherein the plastic flexible tool is adapted to being reciprocated across the surface while contacting the vehicle surface and adhering to the inner surface of the cavity during use.

30. The system of claim 21 wherein the inner surface of the cavity comprises convolutions to facilitate adhesion between the plastic flexible tool and the inner surface of the cavity.

31. The system of claim 21 wherein the inner surface of the cavity is serrated.

32. The system of claim 21 wherein the applicator is adapted to float on water while the plastic flexible tool is contained within the cavity.

33. The system of claim 21 wherein the body comprises a top section and a bottom section, the top section comprising a first compressible material, the bottom section comprising a second compressible material, the first compressible material being more rigid than the second compressible material, and wherein the top section is substantially impermeable to liquid lubricating agents.

34. The system of claim 21 wherein the body comprises a foam that is adapted to store a lubricating agent and release the lubricating agent to the surface during use.

35. The system of claim 21 wherein the plastic tool is disposed within the cavity of the body such that the body covers at least about half of a surface area of the plastic flexible tool during use.

36. A system for polishing a surface, comprising:

a tool comprising a plastic flexible material having mixed therewith an abrasive;

an applicator for guiding the tool, the applicator comprising a body and a cavity having an inner surface, at least a portion of the body being substantially compressible;

and wherein the tool is adapted to be contained within the cavity whereby the inner surface fixably adheres to the tool, and wherein the inner surface of the cavity comprises convolutions to facilitate adhesion between the plastic flexible tool and the inner surface of the cavity.

37. The system of claim 21 wherein the body comprises a bottom surface that substantially surrounds at least a portion of the cavity, and wherein the cavity is adapted to contain the plastic flexible tool such that the tool is recessed within the cavity with respect to the bottom surface during use.

38. The system of claim 21 wherein the body comprises a bottom surface that substantially surrounds at least a portion of the cavity, and wherein the cavity is adapted to contain the plastic flexible tool such that the tool is recessed within the cavity with respect to the bottom surface, and wherein the body is compressible to cause the plastic flexible tool to become substantially flush with the bottom surface during use.

39. The system of claim 21, wherein the plastic film comprises a polyolefin.

40. The system of claim 21 wherein the tool is deformable to substantially conform to the shape of the surface.

41. The system of claim 21, further comprising a lubricating agent for lubricating a portion of the surface.

42. The system of claim 21 wherein the abrasive is substantially homogeneously mixed with the plastic material.

43. The system of claim 21, wherein the plastic film comprises a modulus stain of elasticity according to ASTM test D-882, Method A, of between about 50,000 psi and about 120,000 psi at 73° F.

44. The system of claim 21 wherein the tool comprises between about 6 parts and about 8 parts by weight of abrasive per 10 parts by weight of plastic material.

45. The system of claim 21 wherein at least a portion of the abrasive is flush with an outer surface of the plastic material, and wherein the portion of the abrasive is adapted to slip within the plastic material upon detecting a resistance from the surface during use.

46. The system of claim 21 wherein the abrasive is selected from the group consisting of silica sand, calcium carbonate, alumina, ceramics, and Green Carborundum.

47. The system of claim 21 wherein the system is adapted to apply a first polishing force to a protrusion or stain on the surface and a second polishing force to the surface, and wherein the second polishing force per area is about 1/30 to about 1/200 of the first polishing force per area.

48. A system for polishing a surface, comprising:

a tool comprising a plastic flexible material having mixed therewith an abrasive;

an applicator for guiding the tool, the applicator comprising a body and a cavity having an inner surface, at least a portion of the body being substantially compressible;

and wherein the tool is adapted to be contained within the cavity whereby the inner surface fixably adheres to the tool and wherein the inner surface of the cavity is serrated.

49. The system of claim 21 wherein the tool comprises a plurality of particles dispersed throughout the plastic flexible material, the particles being adapted to knead the plastic flexible material during use.

50. An applicator for polishing a surface with a mechanical polisher, comprising:

a body comprising a top portion and a bottom portion;

a hook-loop fastening system portion located on the top portion for connecting the body to a mating surface on the mechanical polisher; and a cavity formed on the bottom portion, the cavity having an inner surface and being adapted to receive a polishing tool comprising a plastic flexible material having mixed therewith an abrasive and particles, the abrasive comprising grains from about 3 to 50 $\mu$m in diameter, the particles being adapted to knead the plastic flexible material during use, the inner surface being adapted to adhere to the polishing tool to maintain the polishing tool within the cavity during use.

51. The applicator of claim 50 wherein the body is a substantially circular disk, and wherein the cavity has a substantially circular shape.

52. The applicator of claim 50, further comprising an inner hook-loop fastening system portion disposed on the inner surface of the cavity for attaching to a mating surface of the polishing tool.

53. The applicator of claim 50, further comprising an opening in the top portion, the opening being adapted to engage an alignment stud located on the mechanical polisher.

54. The applicator of claim 50, further comprising an opening in the top portion for centering the applicator, the opening being located substantially in the center of the top portion and being adapted to engage a protrusion on the mechanical polisher.

55. The applicator of claim 50 wherein the hook-loop fastening system portion is connected to the body by glue disposed between the hook-loop fastening system portion and the body, the glue causing the applicator to be more rigid proximate the top section than proximate the bottom section.

56. The applicator of claim 50, further comprising a pressure-sensitive adhesive device connecting the hook-loop fastening system portion to the body.

57. The applicator of claim 50 wherein the hook-loop fastening system portion comprises a loop-type hook-loop fastening system portion for attaching to a hook-loop fastening system portion contained on the mating surface of the mechanical applicator.

58. The applicator of claim 50, further comprising an inner hook-loop fastening system portion disposed on the inner surface of the cavity for attaching to a mating surface of the polishing tool, the inner hook-loop fastening system portion comprising a hook-type hook-loop fastening system portion for attaching to a loop-type hook-loop fastening system portion contained on the mating surface of the polishing tool.

59. A system for polishing a surface with a mechanical polisher, comprising:

an applicator comprising a body and a cavity, the body comprising a top portion and a bottom portion, the top portion comprising a connecting portion adapted to form a fixable engagement with a mating portion located on the mechanical polisher, the cavity being formed on the bottom portion and having an inner surface;

a tool comprising a plastic flexible material having mixed therewith an abrasive comprising grains and particles, the particles being adapted to knead the plastic flexible material during use, the tool being adapted to fixably adhere to the inner surface of the cavity and apply a polishing force to the surface during use;

and wherein the connecting portion comprises a hook-or-loop-type portion for attaching to a complementary hook-or-loop-type portion contained on the tool.

60. A system for polishing a surface, comprising:

a tool comprising a plastic flexible material having mixed therewith an abrasive;

an applicator for guiding the tool, the applicator comprising a body and a cavity having an inner surface, at least a portion of the body being substantially compressible;

a plastic film for locating a stain or protrusion on the surface, the plastic film comprising a polyolefin and being sized and adapted to cover at least a portion of a human hand, the plastic film having a thickness between about 0.1 mm and about 0.75 mm;

and wherein the tool is adapted to be contained within the cavity whereby the inner surface of the cavity fixably adheres to the tool.

61. The system of claim 59 wherein the tool comprises a plurality of particles dispersed throughout the plastic flexible material, the particles being adapted to knead the plastic flexible material during use.

62. A system for polishing a surface, comprising:

a tool comprising a plastic flexible material having mixed therewith an abrasive;

an applicator for guiding the tool, the applicator comprising a body and a cavity having an inner surface, at least a portion of the body being substantially compressible;

a plastic film for locating a stain or protrusion on the surface, the plastic film being sized and adapted to cover at least a portion of a human hand, the plastic film having a modulus of elasticity according to ASTM test D-882, Method A, of between about 50,000 psi and about 120,000 psi at 73° F., the plastic film having a thickness between about 0.1 mm and about 0.75 mm;

and wherein the tool is adapted to be contained within the cavity whereby the inner surface fixably adheres to the tool.

63. The system of claim 59 wherein the body further comprises a foam having between about 60 pores per inch square and about 150 pores per square inch.

64. A system for polishing a surface, comprising:

a tool comprising a plastic flexible material having mixed therewith an abrasive comprising grains from about 3

μm to 50 μm in diameter, the grains being adapted to knead the plastic flexible material during use;

an applicator for guiding the tool, the applicator comprising a body and a cavity having an inner surface, at least a portion of the body being substantially compressible;

a hook-loop fastening system portion connected to the inner surface, the hook-loop fastening system portion being adapted to form a fixable engagement with a hook-loop fastening system mating surface of the plastic flexible tool during use;

and wherein the tool is adapted to be contained within the cavity whereby the inner surface fixably adheres to the tool.

65. The system of claim 64, further comprising a plastic film for locating a stain or protrusion on the surface, the plastic film being sized to cover at least a portion of a human hand, the plastic film having a thickness between about 0.1 mm and about 0.75 mm.

66. The system of claim 64 wherein the body comprises a top section and a bottom section, the top section comprising a first compressible material, the bottom section comprising a second compressible material, the first compressible material being more rigid than the second compressible material, and wherein the cavity is formed into the bottom section.

67. The system of claim 64, wherein the body comprises a curve to facilitate grasping of the body.

68. The system of claim 64 wherein the body comprises a top section and a bottom section, the top section comprising a first compressible material, the bottom section comprising a second compressible material, the first compressible material being more rigid than the second compressible material, and wherein the cavity is formed into the bottom section, and wherein the inner surface of the cavity comprises a lower portion of the top section.

69. The system of claim 64 wherein at least a portion of the body is adapted to absorb a lubricating agent during use.

70. The system of claim 64 wherein the body comprises a foam having between about 60 pores per square inch and about 150 pores per square inch.

71. The system of claim 64 wherein the plastic flexible tool is adapted to being reciprocated across the surface while contacting the vehicle surface and adhering to the inner surface of the cavity during use.

72. The system of claim 64 wherein the inner surface of the cavity comprises convolutions to facilitate adhesion between the plastic flexible tool and the inner surface of the cavity.

73. The system of claim 64 wherein the inner surface of the cavity is serrated.

74. The system of claim 64 wherein the applicator is adapted to float on water while the plastic flexible tool is contained within the cavity.

75. The system of claim 64 wherein the body comprises a top section and a bottom section, the top section comprising a first compressible material, the bottom section comprising a second compressible material, the first compressible material being more rigid than the second compressible material, and wherein the top section is substantially impermeable to liquid lubricating agents.

76. The system of claim 64 wherein the body comprises a foam that is adapted to store a lubricating agent and release the lubricating agent to the surface during use.

77. A plastic flexible tool that is removably attachable to an applicator, the plastic flexible tool comprising:

a plastic flexible material having an abrasive mixed in it, wherein the abrasive is substantially homogeneously mixed with and in the plastic material;

a hook-loop fastening system engagement surface coupled to the plastic flexible material;

wherein the hook-loop fastening system engagement surface of the plastic flexible tool is removably attachable to an applicator; and wherein the plastic flexible tool is adaptable for polishing a stain or protrusion from a surface, and the plastic flexible tool is deformable to substantially conform to the shape of the surface.

78. The system of claim 64 wherein the plastic tool is disposed within the cavity of the body such that the body covers at least about half of a surface area of the plastic flexible tool during use.

79. The tool of claim 77 wherein the applicator comprises a body and a cavity and wherein the plastic flexible tool is positionable within the cavity during use such that the body covers at least about half of a surface area of the plastic flexible tool.

80. The tool of claim 77 wherein the plastic flexible tool is adapted to being reciprocated across a surface while contacting the surface and adhering to a planar surface of the applicator during use.

81. The system of claim 64 wherein the body comprises a bottom surface that substantially surrounds at least a portion of the cavity, and wherein the cavity is adapted to contain the plastic flexible tool such that the tool is recessed within the cavity with respect to the bottom surface during use.

82. The system of claim 64 wherein the body comprises a bottom surface that substantially surrounds at least a portion of the cavity, and wherein the cavity is adapted to contain the plastic flexible tool such that the tool is recessed within the cavity with respect to the bottom surface, and wherein the body is compressible to cause the plastic flexible tool to become substantially flush with the bottom surface during use.

83. The tool of claim 77 wherein the abrasive comprises grains from about 3 μm to 50 μm in diameter.

84. The tool of claim 77 wherein the tool comprises between about 6 parts and about 8 parts by weight of abrasive per 10 parts by weight of plastic material.

85. The tool of claim 77 wherein the tool is adaptable for polishing a stain or protrusion from a surface, and wherein at least a portion of the abrasive is flush with an outer surface of the plastic material, and wherein the portion of the abrasive is adapted to slip within the plastic material upon detecting a resistance from the surface during use.

86. The tool of claim 77 wherein the abrasive is selected from the group consisting of silica sand, calcium carbonate, alumina, ceramics, and Green Carborundum.

87. The tool of claim 77 wherein the tool comprises a plurality of particles dispersed throughout the plastic flexible material, the particles being adapted to knead the plastic flexible material during use.

88. The tool of claim 77 wherein the tool is a substantially circular disk.

89. A plastic flexible tool that is removably attachable to an applicator, the plastic flexible tool comprising:

a plastic flexible material having an abrasive mixed in it; wherein the abrasive is substantially homogeneously mixed with and in the plastic material; and a hook-loop fastening system engagement surface coupled to the plastic flexible material; and wherein the hook-loop fastening system engagement surface of the plastic flexible tool is removably attachable to an applicator, and wherein the plastic flexible material is in a substantially planar shape and the hook-loop fastening system engagement surface is substantially planar and is connected to a planar surface of the plastic flexible material, and wherein the plastic flexible tool is adaptable for polishing a stain or protrusion from a surface, and the plastic flexible tool is deformable to substantially conform to the shape of the surfaces.

90. The tool of claim 89 wherein the applicator comprises a body and a cavity and wherein the plastic flexible tool is positionable within the cavity during use such that the body covers at least about half of a surface area of the plastic flexible tool.

91. The tool of claim 89 wherein the plastic flexible tool is adapted to being reciprocated across a surface while contacting the surface and adhering to a planar surface of the applicator during use.

92. The system of claim 64, further comprising a plastic film for locating a stain or protrusion on the surface, the plastic film comprising a polyolefin and being sized and adapted to cover at least a portion of a human hand, the plastic film having a thickness between about 0.1 mm and about 0.75 mm.

93. The system of claim 64 wherein the tool is deformable to substantially conform to the shape of the surface.

94. The tool of claim 89 wherein the abrasive comprises grains from about 3 $\mu$m to 50 $\mu$m in diameter.

95. The tool of claim 89 wherein the tool comprises between about 6 parts and about 8 parts by weight of abrasive per 10 parts by weight of plastic material.

96. The tool of claim 89 wherein the tool is adaptable for polishing a stain or protrusion from a surface, and wherein at least a portion of the abrasive is flush with an outer surface of the plastic material, and wherein the portion of the abrasive is adapted to slip within the plastic material upon detecting a resistance from the surface during use.

97. The tool of claim 89 wherein the abrasive is selected from the group consisting of silica sand, calcium carbonate, alumina, ceramics, and Green Carborundum.

98. The tool of claim 89 wherein the tool comprises a plurality of particles dispersed throughout the plastic flexible material, the particles being adapted to knead the plastic flexible material during use.

99. The tool of claim 89 wherein the tool is a substantially circular disk.

100. A system for polishing a surface, comprising:

a tool comprising a plastic flexible material having mixed therewith an abrasive;

an applicator for guiding the tool, the applicator comprising a body and a cavity having an inner surface, at least a portion of the body being substantially compressible;

and wherein the tool is adapted to be contained within the cavity whereby the inner surface fixably adheres to the tool, and wherein the tool comprises a plurality of particles dispersed throughout the plastic flexible material, the particles being adapted to knead the plastic flexible material during use.

101. A system for polishing a surface with a mechanical polisher, comprising:

an applicator comprising a body and a cavity, the body comprising a top portion and a bottom portion, the top portion comprising a connecting portion adapted to form a fixable engagement with a mating portion located on the mechanical polisher, the cavity being formed on the bottom portion and having an inner surface;

a tool comprising a plastic flexible material having mixed therewith an abrasive comprising grains, the tool being adapted to fixably adhere to the inner surface of the cavity and apply a polishing force to the surface during use;

and wherein the tool comprises a plurality of particles dispersed throughout the plastic flexible material, the particles being adapted to knead the plastic flexible material during use.

102. An applicator for polishing a stain or protrusion from a surface, comprising a body and a cavity, the body comprising a top section and a bottom section, the top section comprising a first material, the bottom section comprising a second compressible material, the first material being more rigid than the second compressible material, the cavity being formed on the bottom section and comprising an inner surface, the inner surface being adapted to fixably adhere to a plastic flexible tool during use, and wherein the applicator has a density that causes the applicator to float on water.

103. A system for polishing a surface, comprising:

a tool comprising a plastic flexible material having mixed therewith an abrasive;

an applicator for guiding the tool, the applicator comprising a body and a cavity having an inner surface, at least a portion of the body being substantially compressible;

and wherein the tool is adapted to be contained within the cavity whereby the inner surface fixably adheres to the tool, and wherein the applicator is adapted to float on water while the plastic flexible tool is contained within the cavity.

104. The system of claim 64, further comprising a lubricating agent for lubricating a portion of the surface.

105. The system of claim 64 wherein the abrasive is substantially homogeneously mixed with the plastic material.

106. The system of claim 64, further comprising a plastic film for locating a stain or protrusion on the surface, the plastic film being sized and adapted to cover at least a portion of a human hand, the plastic film having a modulus of elasticity according to ASTM test D-882, Method A, of between about 50,000 psi and about 120,000 psi at 73° F., the plastic film having a thickness between about 0.1 mm and about 0.75 mm.

107. The system of claim 64 wherein the tool comprises between about 6 parts and about 8 parts by weight of abrasive per 10 parts by weight of plastic material.

108. The system of claim 64 wherein at least a portion of the abrasive is flush with an outer surface of the plastic material, and wherein the portion of the abrasive is adapted to slip within the plastic material upon detecting a resistance from the surface during use.

109. The system of claim 64 wherein the abrasive is selected from the group consisting of silica sand, calcium carbonate, alumina, ceramics, and Green Carborundum.

110. The system of claim 64 wherein the system is adapted to apply a first polishing force to a protrusion or stain on the surface and a second polishing force to the surface, and wherein the second polishing force per area is about 1/30 to about 1/200 of the first polishing force per area.

111. The system of claim 7, wherein the body comprises a curved portion having an ergonomic shape to facilitate grasping of the body.

112. The system of claim 7, wherein at least a portion of the inner surface of the cavity is defined by a lower portion of the top section.

113. The system of claim 7, wherein the bottom section is configured to absorb a polishing compound during use.

114. The system of claim 7, wherein the bottom section comprises a foam having between about 60 pores per inch and about 150 pores per inch.

115. The system of claim 7, wherein the second compressible material can absorb a polishing compound during use, the second compressible material being configured to dispense an amount of the polishing compound upon being compressed during use, and wherein the amount of the polishing compound dispensed varies as a function of a degree to which the second compressible material is compressed during use.

116. The system of claim 7, wherein the applicator has a density that causes the applicator to float on water.

117. The system of claim 7, wherein the top section is substantially impermeable to polishing compounds.

118. The system of claim 7, wherein the applicator further comprises a pressure-sensitive adhesive connecting the top section and the bottom section together.

119. The system of claim 7, wherein the applicator further comprises a glue disposed between the top section and the, bottom section.

120. The system of claim 7, wherein the first compressible material is a plastomer foam and the second compressible material is an elastomer foam.

121. The system of claim 7, wherein the first compressible material is a crosslinked polyethylene foam, and wherein the second compressible material is a urethane foam.

122. The system of claim 7, wherein the first compressible material is a closed-cell metallocene polyolefin foam, and wherein the second compressible material is a urethane foam.

123. The system of claim 7, wherein the applicator further comprises a portion of a hook-loop fastening system located on a top surface of the top section, the portion of the hook-loop fastening system being configured to form a fixable engagement with a complimentary portion of the hook-loop fastening system attached to a mechanical polisher during use.

124. The system of claim 7, wherein the applicator further comprises a portion of a hook-loop fastening system located on a top surface of the top section, the portion of the hook-loop fastening system being configured to form a fixable engagement with a complimentary portion of the hook-loop fastening system attached to a handle during use.

125. The system of claim 7, wherein the body is a substantially circular disk, and wherein the cavity has a substantially circular shape.

126. The system of claim 7, comprising an opening in the top portion, the opening being adapted to engage an alignment stud located on a mechanical polisher.

127. The system of claim 7, further comprising an opening in the top portion for centering the applicator, the opening being located substantially in the center of the top portion and being adapted to engage a protrusion on a mechanical polisher.

128. The system of claim 8, wherein the body comprises a curved portion having an ergonomic shape to facilitate grasping of the body.

129. The system of claim 8, wherein at least a portion of the inner surface of the cavity is defined by a lower portion of the top section.

130. The system of claim 8, wherein the bottom section is configured to absorb a polishing compound during use.

131. The system of claim 8, wherein the bottom section comprises a foam having between about 60 pores per inch and about 150 pores per inch.

132. The system of claim 8, wherein the second compressible material can absorb a polishing compound during use, the second compressible material being configured to dispense an amount of the polishing compound upon being compressed during use, and wherein the amount of the polishing compound dispensed varies as a function of a degree to which the second compressible material is compressed during use.

133. The system of claim 8, wherein the applicator has a density that causes the applicator to float on water.

134. The system of claim 8, wherein the top section is substantially impermeable to polishing compounds.

135. The system of claim 8, wherein the applicator further comprises a pressure-sensitive adhesive connecting the top section and the bottom section together.

136. The system of claim 8, wherein the applicator further comprises a glue disposed between the top section and the bottom section.

137. The system of claim 8, wherein the first compressible material is a plastomer foam and the second compressible material is an elastomer foam.

138. The system of claim 8, wherein the first compressible material is a crosslinked polyethylene foam, and wherein the second compressible material is a urethane foam.

139. The system of claim 8, wherein the first compressible material is a closed-cell metallocene polyolefin foam, and wherein the second compressible material is a urethane foam.

140. The system of claim 8, wherein the applicator further comprises a portion of a hook-loop fastening system located on a top surface of the top section, the portion of the hook-loop fastening system being configured to form a fixable engagement with a complimentary portion of the hook-loop fastening system attached to a mechanical polisher during use.

141. The system of claim 8, wherein the applicator further comprises a portion of a hook-loop fastening system located on a top surface of the top section, the portion of the hook-loop fastening system being configured to form a fixable engagement with a complimentary portion of the hook-loop fastening system attached to a handle during use.

142. The system of claim 8, wherein the body is a substantially circular disk, and wherein the cavity has a substantially circular shape.

143. The system of claim 8, flirter comprising an opening in the top portion, the opening being adapted to engage an alignment stud located on a mechanical polisher.

144. The system of claim 8, further comprising an opening in the top portion for centering the applicator, the opening being located substantially in the center of the top portion and being adapted to engage a protrusion on a mechanical polisher.

145. The system of claim 22, wherein the body comprises a curved portion having an ergonomic shape to facilitate grasping of the body.

146. The system of claim 22, wherein at least a portion of the inner surface of the cavity is defined by a lower portion of the top section.

147. The system of claim 22, wherein the bottom section is configured to absorb a polishing compound during use.

148. The system of claim 22, wherein the second compressible material can absorb a polishing compound during use, the second compressible material being configured to dispense an amount of the polishing compound upon being compressed during use, and wherein the amount of the polishing compound dispensed varies as a function of a degree to which the second compressible material is compressed during use.

149. The system of claim 22, wherein the applicator has a density that causes the applicator to float on water.

150. The system of claim 22, wherein the top section is substantially impermeable to polishing compounds.

151. The system of claim 22, wherein the applicator further comprises a portion of a hook-loop fastening system positioned on the inner surface of the cavity, the portion of the hook-loop fastening system being configured to form a fixable engagement with a complimentary portion of the hook-loop fastening system attached to the tool during use.

152. The system of claim 22, wherein the applicator further comprises a pressure-sensitive adhesive connecting the top section and the bottom section together.

153. The system of claim 22, wherein the applicator further comprises a glue disposed between the top section and the bottom section.

154. The system of claim 22, wherein the applicator further comprises a portion of a hook-loop fastening system located on a top surface of the top section, the portion of the hook-loop fastening system being configured to form a fixable engagement with a complimentary portion of the hook-loop fastening system attached to a mechanical polisher during use.

155. The system of claim 22, wherein the body is a substantially circular disk, and wherein the cavity has a substantially circular shape.

156. The system of claim 22, further comprising an opening in the top portion, the opening being adapted to engage an aligment stud located on a mechanical polisher.

157. The system of claim 22, further comprising an opening in the top portion for centering the applicator, the opening being located substantially in the center of the top portion and being adapted to engage a protrusion on a mechanical polisher.

158. The system of claim 22, wherein the inner surface of the cavity comprises convolutions to facilitate adhesion between the plastic flexible tool and the inner surface of the cavity.

159. The system of claim 22, wherein the inner surface of the cavity is serrated to facilitate adhesion between the plastic flexible tool and the inner surface of the cavity.

160. The system of claim 23, wherein the body comprises a curved portion having an ergonomic shape to facilitate grasping of the body.

161. The system of claim 23, wherein the body is configured to absorb a polishing compound during use.

162. The system of claim 23, wherein the body can absorb a polishing compound during use, the body being configured to dispense an amount of the polishing compound upon being compressed during use, and wherein the amount of the polishing compound dispensed varies as a function of a degree to which the body is compressed during use.

163. The system of claim 23, wherein the applicator has a density that causes the applicator to float on water.

164. The system of claim 23, wherein the applicator further comprises a portion of a hook-loop fastening system positioned on the inner surface of the cavity, the portion of the hook-loop fastening system being configured to form a fixable engagement with a complimentary portion of the hook-loop fastening system attached to the tool during use.

165. The system of claim 23, wherein the body comprises a bottom surface located about a perimeter of the cavity, and wherein the cavity is configured to contain the tool such that the tool is recessed within the cavity with respect to the bottom surface during use.

166. The system of claim 23, wherein the body comprises a bottom surface about a perimeter of the cavity, and wherein the cavity is configured to contain the tool such that the tool is recessed within the cavity with respect to the bottom surface during use, and wherein the body is compressible to cause the tool to become substantially flush with the bottom surface during use.

167. The system of claim 23, wherein a thickness of the tool is substantially greater than a depth of the cavity such that a portion of the tool extends out from the cavity during use.

168. The system of claim 23, wherein the body comprises a bottom surface about a perimeter of the cavity, and wherein a thickness of the tool is substantially equal to a depth of the cavity such that an upper surface of the tool is substantially flush with the bottom surface of the body during use.

169. The system of claim 23, wherein the tool is deformable to substantially conform to the shape of the surface.

170. The system of claim 23, wherein the abrasive grains have a diameter of about 3 $\mu$m to about 50 $\mu$m.

171. The system of claim 23, wherein the abrasive grains are substantially homogeneously mixed with the plastic flexible material.

172. The system of claim 23, wherein the tool comprises between about 6 parts and about 8 parts of abrasive per 10 parts by weigh of plastic flexible material.

173. The system of claim 23, wherein the abrasive comprises silica sand, calcium carbonate, alumina, ceramics, and Green Carborundum.

174. The system of claim 23, wherein the tool comprises a plurality of particles dispersed throughout the plastic flexible material, the particles being adapted to knead the plastic flexible material during use.

175. The system of claim 23, wherein the tool further comprises a portion of a hook-loop fastening system for attaching the tool to the applicator, the portion being disposed upon an outer surface of the tool.

176. The system of claim 23, wherein the tool is adapted to being reciprocated across a surface while contacting the surface and adhering to the inner surface of the cavity during use.

177. The system of claim 23, wherein the applicator further comprises a portion of a hook-loop fastening system located on a top surface of the body, the portion of the hook-loop fastening system being configured to form a fixable engagement with a complimentary portion of the hook-loop fastening system attached to a mechanical polisher during use.

178. The system of claim 23, further comprising a polishing compound.

179. The system of claim 23, wherein the plastic film comprises a modulus of elasticity according to ASTM test D-882, Method A, of between about 50,000 psi and about 120,000 psi at 73° F.

180. The system of claim 23, wherein the plastic film comprise a polyolefin.

181. The system of claim 23, wherein the tool is positionable within the cavity during use such that the body covers at least about half of a surface area of the tool.

182. The system of claim 23, wherein the body is a substantially circular disk, and wherein the cavity has a substantially circular shape.

183. The system of claim 23, further comprising an opening in a top portion of the body, the opening being adapted to engage an alignment stud located on a mechanical polisher.

184. The system of claim 23, further comprising an opening in a top portion of the body for centering the applicator, the opening being located substantially in the center of the top portion and being adapted to engage a protrusion on a mechanical polisher.

185. The system of claim 23, wherein the inner surface of the cavity comprises convolutions to facilitate adhesion between the plastic flexible tool and the inner surface of the cavity.

186. The system of claim 23, wherein the inner surface of the cavity is serrated to facilitate adhesion between the plastic flexible tool and the inner surface of the cavity.

187. The system of claim 36, wherein the body comprises a curved portion having an ergonomic shape to facilitate grasping of the body.

188. The system of claim 36, wherein the body is configured to absorb a polishing compound during use.

189. The system of claim 36, wherein the body can absorb a polishing compound during use, the body being configured to dispense an amount of the polishing compound upon being compressed during use, and wherein the amount of the polishing compound dispensed varies as a function of a degree to which the body is compressed during use.

190. The system of claim 36, wherein the applicator has a density that causes the applicator to float on water.

191. The system of claim 36, wherein the applicator is adapted to float on water while the plastic flexible tool is contained within the cavity.

192. The system of claim 36, wherein the body comprises a bottom surface located about a perimeter of the cavity, and wherein the cavity is configured to contain the tool such that the tool is recessed within the cavity with respect to the bottom surface during use.

193. The system of claim 36, wherein the body comprises a bottom surface about a perimeter of the cavity, and wherein the cavity is configured to contain the tool such that the tool is recessed within the cavity with respect to the bottom surface during use, and wherein the body is compressible to cause the tool to become substantially flush with the bottom surface during use.

194. The system of claim 36, wherein a thickness of the tool is substantially greater than a depth of the cavity such that a portion of the tool extends out from the cavity during use.

195. The system of claim 36, wherein the body comprises a bottom surface about a perimeter of the cavity, and wherein a thickness of the tool is substantially equal to a depth of the cavity such that an upper surface of the tool is substantially flush with the bottom surface of the body during use.

196. The system of claim 36, wherein the tool is deformable to substantially conform to the shape of the surface.

197. The system of claim 36, wherein the abrasive grains have a diameter of about 3 $\mu$m to about 50 $\mu$m.

198. The system of claim 36, wherein the abrasive grains are substantially homogeneously mixed with the plastic flexible material.

199. The system of claim 36, wherein the tool comprises between about 6 parts and about 8 parts of abrasive per 10 parts by weigh of plastic flexible material.

200. The system of claim 36, wherein the abrasive comprises silica sand, calcium carbonate, alumina, ceramics, and Green Carborundum.

201. The system of claim 36, wherein the tool comprises a plurality of particles dispersed throughout the plastic flexible material , the particles being adapted to knead the plastic flexible material during use.

202. The system of claim 36, wherein the tool is adapted to being reciprocated across the surface while contacting the surface and adhering to the inner surface of the cavity during use.

203. The system of claim 36, wherein the applicator further comprises a portion of a hook-loop fastening system located on a top surface of the body, the portion of the hook-loop fastening system being configured to form a fixable engagement with a complimentary portion of the hook-loop fastening system attached to a mechanical polisher during use.

204. The system of claim 36, further comprising a plastic film for locating a stain or protrusion on the surface of the vehicle, the plastic film being sized to cover at least a portion of a human hand, the plastic film having a thickness between about 0.1 mm and about 0.75 mm.

205. The system of claim 36, further comprising a polishing compound.

206. The system of claim 36, further comprising a plastic film for locating a stain or protrusion on the surface of the vehicle, the plastic film being sized and adapted to cover at least a portion of a human hand, the plastic film having a modulus of elasticity according to ASTM test D-882, Method A, of between about 50,000 psi and about 120,000 psi at 73° F., the plastic film having a thickness between about 0.1 mm and about 0.75 mm.

207. The system of claim 36, further comprising a plastic film for locating a stain or protrusion on the surface of the vehicle, the plastic film being sized to cover at least a portion of a human hand, the plastic film having a thickness between about 0.1 mm and about 0.75 mm, and wherein the plastic film comprises a polyolefin.

208. The system of claim 36, wherein the tool is positionable within the cavity during use such that the body covers at least about half of a surface area of the tool.

209. The system of claim 36, wherein the body is a substantially circular disk, and wherein the cavity has a substantially circular shape.

210. The system of claim 36, further comprising an opening in a top portion of the body, the opening being adapted to engage an alignment stud located on a mechanical polisher.

211. The system of claim 36, further comprising an opening in a top portion of the body for centering the applicator, the opening being located substantially in the center of the top portion and being adapted to engage a protrusion on a mechanical polisher.

212. The system of claim 48, wherein the body comprises a curved portion having an ergonomic shape to facilitate grasping of the body.

213. The system of claim 48, wherein the body is configured to absorb a polishing compound during use.

214. The system of claim 48, wherein the body can absorb a polishing compound during use, the body being configured to dispense an amount of the polishing compound upon being compressed during use, and wherein the amount of the polishing compound dispensed varies as a function of a degree to which the body is compressed during use.

215. The system of claim 48, wherein the applicator has a density that causes the applicator to float on water.

216. The system of claim 48, wherein the applicator is adapted to float on water while the plastic flexible tool is contained within the cavity.

217. The system of claim 48, wherein the body comprises a bottom surface located about a perimeter of the cavity, and wherein the cavity is configured to contain the tool such that the tool is recessed within the cavity with respect to the bottom surface during use.

218. The system of claim 48, wherein the body comprises a bottom surface about a perimeter of the cavity, and wherein the cavity is configured to contain the tool such that the tool is recessed within the cavity with respect to the bottom surface during use, and wherein the body is compressible to cause the tool to become substantially flush with the bottom surface during use.

219. The system of claim 48, wherein a thickness of the tool is substantially greater than a depth of the cavity such that a portion of the tool extends out from the cavity during use.

220. The system of claim 48, wherein the body comprises a bottom surface about a perimeter of the cavity, and wherein a thickness of the tool is substantially equal to a depth of the cavity such that an upper surface of the tool is substantially flush with the bottom surface of the body during use.

221. The system of claim 48, wherein the tool is deformable to substantially conform to the shape of the surface.

222. The system of claim 48, the abrasive grains have a diameter of about 3 $\mu$m to about 50 $\mu$m.

223. The system of claim 48, wherein the abrasive grains are substantially homogeneously mixed with the plastic flexible material.

224. The system of claim 48, wherein the tool comprises between about 6 parts and about 8 parts of abrasive per 10 parts by weigh of plastic flexible material.

225. The system of claim 48, wherein the abrasive comprises silica sand, calcium carbonate, alumina, ceramics, and Green Carborundum.

226. The system of claim 48, wherein the tool comprises a plurality of particles dispersed throughout the plastic flexible material , the particles being adapted to knead the plastic flexible material during use.

227. The system of claim 48, wherein the tool is adapted to being reciprocated across the surface while contacting the surface and adhering to the inner surface of the cavity during use.

228. The system of claim 48, wherein the applicator further comprises a portion of a hook-loop fastening system located on a top surface of the body, the portion of the hook-loop fastening system being configured to form a fixable engagement with a complimentary portion of the hook-loop fastening system attached to a mechanical polisher during use.

229. The system of claim 48, further comprising a plastic film for locating a stain or protrusion on the surface of the vehicle, the plastic film being sized to cover at least a portion of a human hand, the plastic film having a thickness between about 0.1 mm and about 0.75 mm.

230. The system of claim 48, further comprising a polishing compound.

231. The system of claim 48, further comprising a plastic film for locating a stain or protrusion on the surface of the vehicle, the plastic film being sized and adapted to cover at least a portion of a human hand, the plastic film having a modulus of elasticity according to AST test D-882, Method A, of between about 50,000 psi and about 120,000 psi at 73° F, the plastic film having a thickness between about 0.1 mm and about 0.75 mm.

232. The system of claim 60, further comprising a plastic film for locating a stain or protrusion on the surface of the vehicle, the plastic film being sized to cover at least a portion of a human hand, the plastic film having a thickness between about 0.1 mm and about 0.75 mm, and wherein the plastic film comprises a polyolefin.

233. The system of claim 60, wherein the tool is positionable within the cavity during use such that the body covers at least about half of a surface area of the tool.

234. The system of claim 60, wherein the body is a substantially circular disk, and wherein the cavity has a substantially circular shape.

235. The system of claim 60, further comprising an opening in a top portion of the body, the opening being adapted to engage an alignment stud located on a mechanical polisher.

236. The system of claim 60, further comprising an opening in a top portion of the body for centering the applicator, the opening being located substantially in the center of the top portion and being adapted to engage a protrusion on a mechanical polisher.

237. The system of claim 60, wherein the body comprises a curved portion having an ergonomic shape to facilitate grasping of the body.

238. The system of claim 60, wherein the body is configured to absorb a polishing compound during use.

239. The system of claim 60, wherein the body can absorb a polishing compound during use, the body being configured to dispense an amount of the polishing compound upon being compressed during use, and wherein the amount of the polishing compound dispensed varies as a function of a degree to which the body is compressed during use.

240. The system of claim 60, wherein the applicator has a density that causes the applicator to float on water.

241. The system of claim 60, wherein the applicator further comprises a portion of a hook-loop fastening system positioned on the inner surface of the cavity, the portion of the hook-loop fastening system being configured to form a fixable engagement with a complimentary portion of the hook-loop fastening system attached to the tool during use.

242. The system of claim 60, wherein the body comprises a bottom surface located about a perimeter of the cavity, and wherein the cavity is configured to contain the tool such that the tool is recessed within the cavity with respect to the bottom surface during use.

243. The system of claim 60, wherein the body comprises a bottom surface about a perimeter of the cavity, and wherein the cavity is configured to contain the tool such that the tool is recessed within the cavity with respect to the bottom surface during use, and wherein the body is compressible to cause the tool to become substantially flush with the bottom surface during use.

244. The system of claim 60, wherein a thickness of the tool is substantially greater than a depth of the cavity such that a portion of the tool extends out from the cavity during use.

245. The system of claim 60, wherein the body comprises a bottom surface about a perimeter of the cavity, and wherein a thickness of the tool is substantially equal to a depth of the cavity such that an upper surface of the tool is substantially flush with the bottom surface of the body during use.

246. The system of claim 60, wherein the tool is deformable to substantially conform to the shape of the surface.

247. The system of claim 60, wherein the abrasive grains have a diameter of about 3 $\mu$m to about 50 $\mu$m.

248. The system of claim 60, wherein the abrasive grains are substantially homogeneously mixed with the plastic flexible material.

249. The system of claim 60, wherein the tool comprises between about 6 parts and about 8 parts of abrasive per 10 parts by weigh of plastic flexible material.

250. The system of claim 60, wherein the abrasive comprises silica sand, calcium carbonate, alumina, ceramics, and Green Carborundum.

251. The system of claim 60, wherein the tool comprises a plurality of particles dispersed throughout the plastic flexible material, the particles being adapted to knead the plastic flexible material during use.

252. The system of claim 60, wherein the tool further comprises a portion of a hook-loop fastening system for attaching the tool to the applicator, the portion being disposed upon an outer surface of the tool.

253. The system of claim 60, wherein the tool is adapted to being reciprocated across a surface while contacting the surface and adhering to the inner surface of the cavity during use.

254. The system of claim 60, wherein the applicator further comprises a portion of a hook-loop fastening system located on a top surface of the body, the portion of the hook-loop fastening system being configured to form a fixable engagement with a complimentary portion of the hook-loop fastening system attached to a mechanical polisher during use.

255. The system of claim 60, further comprising a polishing compound.

256. The system of claim 60, wherein the plastic film comprises a modulus of elasticity according to ASTM test D-882, Method A, of between about 50,000 psi and about 120,000 psi at 73° F.

257. The system of claim 60, wherein the tool is positionable within the cavity during use such that the body covers at least about half of a surface area of the tool.

258. The system of claim 60, wherein the body is a substantially circular disk, and wherein the cavity has a substantially circular shape.

259. The system of claim 60, further comprising an opening in a top portion of the body, the opening being adapted to engage an alignment stud located on a mechanical polisher.

260. The system of claim 60, further comprising an opening in a top portion of the body for centering the applicator, the opening being located substantially in the center of the top portion and being adapted to engage a protrusion on a mechanical polisher.

261. The system of claim 60, wherein the inner surface of the cavity comprises convolutions to facilitate adhesion between the plastic flexible tool and the inner surface of the cavity.

262. The system of claim 60, wherein the inner surface of the cavity is serrated to facilitate adhesion between the plastic flexible tool and the inner surface of the cavity.

263. The system of claim 62, wherein the body comprises a curved portion having an ergonomic shape to facilitate grasping of the body.

264. The system of claim 62, wherein the body is configured to absorb a polishing compound during use.

265. The system of claim 62, wherein the body can absorb a polishing compound during use, the body being configured to dispense an amount of the polishing compound upon being compressed during use, and wherein the amount of the polishing compound dispensed varies as a function of a degree to which the body is compressed during use.

266. The system of claim 62, wherein the applicator has a density that causes the applicator to float on water.

267. The system of claim 62, wherein the applicator further comprises a portion of a hook-loop fastening system positioned on the inner surface of the cavity, the portion of the hook-loop fastening system being configured to form a fixable engagement with a complimentary portion of the hook-loop fastening system attached to the tool during use.

268. The system of claim 62, wherein the body comprises a bottom surface located about a perimeter of the cavity, and wherein the cavity is configured to contain the tool such that the tool is recessed within the cavity with respect to the bottom surface during use.

269. The system of claim 62, wherein the body comprises a bottom surface about a perimeter of the cavity, and wherein the cavity is configured to contain the tool such that the tool is recessed within the cavity with respect to the bottom surface during use, and wherein the body is compressible to cause the tool to become substantially flush with the, bottom surface during use.

270. The system of claim 62, wherein a thickness of the tool is substantially greater than a depth of the cavity such that a portion of the tool extends out from the cavity during use.

271. The system of claim 62, wherein the body comprises a bottom surface about a perimeter of the cavity, and wherein a thickness of the tool is substantially equal to a depth of the cavity such that an upper surface of the tool is substantially flush with the bottom surface of the body during use.

272. The system of claim 62, wherein the tool is definable to substantially conform to the shape of the surface.

273. The system of claim 62, wherein the abrasive grains have a diameter of about 3 $\mu$m to about 50 $\mu$m.

274. The system of claim 62, wherein the abrasive grains are substantially homogeneously mixed with the plastic flexible material.

275. The system of claim 62, wherein the tool comprises between about 6 parts and about 8 parts of abrasive per 10 parts by weigh of plastic flexible material.

276. The system of claim 62, wherein the abrasive comprises silica sand, calcium carbonate, alumina, ceramics, and Green Carborundum.

277. The system of claim 62, wherein the tool comprises a plurality of particles dispersed throughout the plastic flexible material, the particles being adapted to knead the plastic flexible material during use.

278. The system of claim 62, wherein the tool further comprises a portion of a hook-loop fastening system for attaching the tool to the applicator, the portion being disposed upon an outer surface of the tool.

279. The system of claim 62, wherein the tool is adapted to being reciprocated across a surface while contacting the surface and adhering to the inner surface of the cavity during use.

280. The system of claim 62, wherein the applicator further comprises a portion of a hook-loop fastening system located on a top surface of the body, the portion of the hook-loop fastening system being configured to form a fixable engagement with a complimentary portion of the hook-loop fastening system attached to a mechanical polisher during use.

281. The system of claim 62, further comprising a polishing compound.

282. The system of claim 62, wherein the plastic film comprise a polyolefin.

283. The system of claim 62, wherein the tool is positionable within the cavity during use such that the body covers at least about half of a surface area of the tool.

284. The system of claim 62, wherein the body is a substantially circular disk, and wherein the cavity has a substantially circular shape.

285. The system of claim 62, further comprising an opening in a top portion of the body, the opening being adapted to engage an alignment stud located on a mechanical polisher.

286. The system of claim 62, further comprising an opening in a top portion of the body for centering the applicator, the opening being located substantially in the center of the top portion and being adapted to engage a protrusion on a mechanical polisher.

287. The system of claim 62, wherein the inner surface of the cavity comprises convolutions to facilitate adhesion between the plastic flexible tool and the inner surface of the cavity.

288. The system of claim 62, wherein the inner surface of the cavity is serrated to facilitate adhesion between the plastic flexible tool and the inner surface of the cavity.

289. The system of claim 100, wherein the body comprises a curved portion having an ergonomic shape to facilitate grasping of the body.

290. The system of claim 100, wherein the body is configured to absorb a polishing compound during use.

291. The system of claim 100, wherein the body can absorb a polishing compound during use, the body being configured to dispense an amount of the polishing compound upon being compressed during use, and wherein the amount of the polishing compound dispensed varies as a function of a degree to which the body is compressed during use.

292. The system of claim 100, wherein the applicator has a density that causes the applicator to float on water.

293. The system of claim 100, wherein the applicator is adapted to float on water while the plastic flexible tool is contained within the cavity.

294. The system of claim 100, wherein the body comprises a bottom surface located about a perimeter of the cavity, and wherein the cavity is configured to contain the tool such that the tool is recessed within the cavity with respect to the bottom surface during use.

295. The system of claim 100, wherein the body comprises a bottom surface about a perimeter of the cavity, and wherein the cavity is configured to contain the tool such that the tool is recessed within the cavity with respect to the bottom surface during use, and wherein the body is compressible to cause the tool to become substantially flush with the bottom surface during use.

296. The system of claim 100, wherein a thickness of the tool is substantially greater than a depth of the cavity such that a portion of the tool extends out from the cavity during use.

297. The system of claim 100, wherein the body comprises a bottom surface about a perimeter of the cavity, and wherein a thickness of the tool is substantially equal to a depth of the cavity such that an upper surface of the tool is substantially flush with the bottom surface of the body during use.

298. The system of claim 100, wherein the tool is deformable to substantially conform to the shape of the surface.

299. The system of claim 100, wherein the abrasive grains have a diameter of about 3 $\mu$m to about 50 $\mu$m.

300. The system of claim 100, wherein the abrasive grains are substantially homogeneously mixed with the plastic flexible material.

301. The system of claim 100, wherein the tool comprises between about 6 parts and about 8 parts of abrasive per 10 parts by weigh of plastic flexible material.

302. The system of claim 100, wherein the abrasive comprises silica sand, calcium carbonate, alumina, ceramics, and Green Carborundum.

303. The system of claim 100, wherein the tool is adapted to being reciprocated across the surface while contacting the surface and adhering to the inner surface of the cavity during use.

304. The system of claim 100, wherein the applicator further comprises a portion of a hook-loop fastening system located on a top surface of the body, the portion of the hook-loop fastening system being configured to form a fixable engagement with a complimentary portion of the hook-loop fastening system attached to a mechanical polisher during use.

305. The system of claim 100, further comprising a plastic film for locating a stain or protrusion on the surface of the vehicle, the plastic film being sized to cover at least a portion of a human hand, the plastic film having a thickness between about 0.1 mm and about 0.75 mm.

306. The system of claim 100, further comprising a polishing compound.

307. The system of claim 100, further comprising a plastic film for locating a stain or protrusion on the surface of the vehicle, the plastic film being sized and adapted to cover at least a portion of a human hand, the plastic film having a modulus of elasticity according to ASTM test D-882, Method A, of between about 50,000 psi and about 120,000 psi at 73° F, the plastic film having a thickness between about 0.1 mm and about 0.75 mm.

308. The system of claim 100, further comprising a plastic film for locating a stain or protrusion on the surface of the vehicle, the plastic film being sized to cover at least a portion of a human hand, the plastic film having a thickness between about 0.1 mm and about 0.75 mm, and wherein the plastic film comprises a polyolefin.

309. The system of claim 100, wherein the tool is positionable within the cavity during use such that the body covers at least about half of a surface area of the tool.

310. The system of claim 100, wherein the body is a substantially circular disk, and wherein the cavity has a substantially circular shape.

311. The system of claim 100, further comprising an opening in a top portion of the body, the opening being adapted to engage an alignment stud located on a mechanical polisher.

312. The system of claim 100, further comprising an opening in a top portion of the body for centering the applicator, the opening being located substantially in the center of the top portion and being adapted to engage a protrusion on a mechanical polisher.

313. The system of claim 101, wherein the body comprises a curved portion having an ergonomic shape to facilitate grasping of the body.

314. The system of claim 101, wherein the bottom portion is configured to absorb a polishing compound during use.

315. The system of claim 101, wherein the bottom portion can absorb a polishing compound during use, the bottom portion being configured to dispense an amount of the polishing compound upon being compressed during use, and wherein the amount of the polishing compound dispensed varies as a function of a degree to which the bottom portion is compressed during use.

316. The system of claim 101, wherein the applicator has a density that causes the applicator to float on water.

317. The system of claim 101, wherein the applicator is adapted to float on water while the plastic flexible tool is contained within the cavity.

318. The system of claim 101, wherein the body comprises a bottom surface located about a perimeter of the cavity, and wherein the cavity is configured to contain the tool such that the tool is recessed within the cavity with respect to the bottom surface during use.

319. The system of claim 101, wherein the body comprises a bottom surface about a perimeter of the cavity, and wherein the cavity is configured to contain the tool such that the tool is recessed within the cavity with respect to the bottom surface during use, and wherein the body is compressible to cause the tool to become substantially flush with the bottom surface during use.

320. The system of claim 101, wherein a thickness of the tool is substantially greater than a depth of the cavity such that a portion of the tool extends out from the cavity during use.

321. The system of claim 101, wherein the body comprises a bottom surface about a perimeter of the cavity, and wherein a thickness of the tool is substantially equal to a depth of the cavity such that an upper surface of the tool is substantially flush with the bottom surface of the body during use.

322. The system of claim 101, wherein the tool is deformable to substantially conform to the shape of the surface.

323. The system of claim 101, wherein the abrasive grains have a diameter of about 3 $\mu$m to about 50 $\mu$m.

324. The system of claim 101, wherein the abrasive grains are substantially homogeneously mixed with the plastic flexible material.

325. The system of claim 101, wherein the tool comprises between about 6 parts and about 8 parts of abrasive per 10 parts by weigh of plastic flexible material.

326. The system of claim 101, wherein the abrasive comprises silica sand, calcium carbonate, alumina, ceramics, and Green Carborundum.

327. The system of claim 101, wherein the tool is adapted to being reciprocated across the surface while contacting the surface and adhering to the inner surface of the cavity during use.

328. The system of claim 101, further comprising a plastic film for locating a stain or protrusion on the surface of the vehicle, the plastic film being sized to cover at least a portion of a human hand, the plastic film having a thickness between about 0.1 mm and about 0.75 mm.

329. The system of claim 101, further comprising a polishing compound.

330. The system of claim 101, further comprising a plastic film for locating a stain or protrusion on the surface of the vehicle, the plastic film being sized and adapted to cover at least a portion of a human hand, the plastic film having a modulus of elasticity according to ASTM test D-882, Method A, of between about 50,000 psi and about 120,000 psi at 73SF, the plastic film having a thickness between about 0.1 mm and about 0.75 mm.

331. The system of claim 101, further comprising a plastic film for locating a stain or protrusion on the surface of the vehicle, the plastic film being sized to cover at least a portion of a human hand, the plastic film having a thickness between about 0.1 mm and about 0.75 mm, and wherein the plastic film comprises a polyolefin.

332. The system of claim 101, wherein the tool is positionable within the cavity during use such that the body covers at least about half of a surface area of the tool.

333. The system of claim 101, wherein the body is a substantially circular disk, and wherein the cavity has a substantially circular shape.

334. The system of claim 101, further comprising an opening in a top portion of the body, the opening being adapted to engage an alignment stud located on the mechanical polisher.

335. The system of claim 101, further comprising an opening in a top portion of the body for centering the applicator, the opening being located substantially in the center of the top portion and being adapted to engage a protrusion on the mechanical polisher.

336. The system of claim 102, wherein the body comprises a curved portion having an ergonomic shape to facilitate grasping of the body.

337. The system of claim 102, wherein at least a portion of the inner surface of the cavity is defined by a lower portion of the top section.

338. The system of claim 102, wherein the bottom section is configured to absorb a polishing compound during use.

339. The system of claim 102, wherein the bottom section comprises a foam having between about 60 pores per inch and about 150 pores per inch.

340. The system of claim 102, wherein the second compressible material can absorb a polishing compound during use, the second compressible material being configured to dispense an amount of the polishing compound upon being compressed during use, and wherein the amount of the polishing compound dispensed varies as a function of a degree to which the second compressible material is compressed during use.

341. The system of claim 102, wherein the top section is substantially impermeable to polishing compounds.

342. The system of claim 102, wherein the applicator further comprises a pressure-sensitive adhesive connecting the top section and the bottom section together.

343. The system of claim 102, wherein the applicator further comprises a glue disposed between the top section and the bottom section.

344. The system of claim 102, wherein the first compressible material is a plastomer foam and the second compressible material is an elastomer foam.

345. The system of claim 102, wherein the first compressible material is a crosslinked polyethylene foam, and wherein the second compressible material is a urethane foam.

346. The system of claim 102, wherein the first compressible material is a closed-cell metallocene polyolefin foam, and wherein the second compressible material is a urethane foam.

347. The system of claim 102, wherein the applicator further comprises a portion of a hook-loop fastening system located on a top surface of the top section, the portion of the hook-loop fastening system being configured to form a fixable engagement with a complimentary portion of the hook-loop fastening system attached to a mechanical polisher during use.

348. The system of claim 102, wherein the applicator further comprises a portion of a hook-loop fastening system located on a top surface of the top section, the portion of the hook-loop fastening system being configured to form a fixable engagement with a complimentary portion of the hook-loop fastening system attached to a handle during use.

349. The system of claim 102, wherein the body is a substantially circular disk, and wherein the cavity has a substantially circular shape.

350. The system of claim 102, further comprising an opening in the top portion, the opening being adapted to engage an alignment stud located on a mechanical polisher.

351. The system of claim 102, further comprising an opening in the top portion for centering the applicator, the opening being located substantially in the center of the top portion and being adapted to engage a protrusion on a mechanical polisher.

352. The system of claim 103, wherein the body comprises a curved portion having an ergonomic shape to facilitate grasping of the body.

353. The system of claim 103, wherein the body is configured to absorb a polishing compound dog use.

354. The system of claim 103, wherein the body can absorb a polishing compound during use, the body being configured to dispense an amount of the polishing compound upon being compressed during uses and wherein the amount of the polishing compound dispensed varies as a function of a degree to which the body is compressed during use.

355. The system of claim 103, wherein the body comprises a bottom surface located about a perimeter of the cavity, and wherein the cavity is configured to contain the tool such that the tool is recessed within the cavity with respect to the bottom surface during use.

356. The system of claim 103, wherein the body comprises a bottom surface about a perimeter of the cavity, and wherein the cavity is configured to contain the tool such that the tool is recessed within the cavity with respect to the bottom surface during use, and wherein the body is compressible to cause the tool to become substantially flush with the bottom surface during use.

357. The system of claim 103, wherein a thickness of the tool is substantially greater than a depth of the cavity such that a portion of the tool extends out from the cavity during use.

358. The system of claim 103, wherein the body comprises a bottom surface about a perimeter of the cavity, and wherein a thickness of the tool is substantially equal to a depth of the cavity such that an upper surface of the tool is substantially flush with the bottom surface of the body during use.

359. The system of claim 103, wherein the tool is deformable to substantially conform to the shape of the surface.

360. The system of claim 103, wherein the abrasive grains have a diameter of about 3 $\mu$m to about 50 $\mu$m.

361. The system of claim 103, wherein the abrasive grains are substantially homogeneously mixed with the plastic flexible material.

362. The system of claim 103, wherein the tool comprises between about 6 parts and about 8 parts of abrasive per 10 parts by weigh of plastic flexible material.

363. The system of claim 103, wherein the abrasive comprises silica sand, calcium carbonate, alumina, ceramics, and Green Carborundum.

364. The system of claim 103, wherein the tool comprises a plurality of particles dispersed throughout the plastic flexible material, the particles being adapted to knead the plastic flexible material during use.

365. The system of claim 103, wherein the tool is adapted to being reciprocated across the surface while contacting the surface and adhering to the inner surface of the cavity during use.

366. The system of claim 103, wherein the applicator further comprises a portion of a hook-loop fastening system located on a top surface of the body, the portion of the hook-loop fastening system being configured to form a fixable engagement with a complimentary portion of the hook-loop fastening system attached to a mechanical polisher during use.

367. The system of claims 103, further comprising a plastic film for locating a stain or protrusion on the surface of the vehicle, the plastic film being sized to cover at least a portion of a human hand, the plastic film having a thickness between about 0.1 mm and about 0.75 mm.

368. The system of claim 103, further comprising a polishing compound.

369. The system of claim 103, further comprising a plastic film for locating a stain or protrusion on the surface of the vehicle, the plastic film being sized and adapted to cover at least a portion of a human hand, the plastic film having a modulus of elasticity according to ASTM test D-882, Method A, of between about 50,000 psi and about 120,000 psi at 73° F, the plastic film having a thickness between about 0.1 mm and about 0.75 mm.

370. The system of claim 103 further comprising a plastic film for locating a stain or protrusion on the surface of the vehicle, the plastic film being sized to cover at least a portion of a human hand, the plastic film having a thickness between about 0.1 mm and about 0.75 mm, and wherein the plastic film comprises a polyolefin.

371. The system of claim 103, wherein the tool is positionable within the cavity during use such that the body covers at least about half of a surface area of the tool.

372. The system of claim 103, wherein the body is a substantially circular disk, and wherein the cavity has a substantially circular shape.

373. The system of claim 103, further comprising an opening in a top portion of the body, the opening being adapted to engage an alignment stud located on a mechanical polisher.

374. The system of claim 103, further comprising an opening in a top portion of the body for centering the applicator, the opening being located substantially in the center of the top portion and being adapted to engage a protrusion on a mechanical polisher.

375. An applicator for polishing a stain or protrusion from a surface, comprising a body, a cavity, and a hook-loop fastening system portion connected to the inner surface, the hook-loop fastening system portion being adapted to form a fixable engagement with a hook-loop fastening system mating surface of a plastic flexible tool during use, the body comprising a top section and a bottom section, the top section comprising a first material, the bottom section comprising a second compressible material, the first material being more rigid than the second compressible material, the cavity being formed on the bottom section and comprising an inner surface, the inner surface being serrated to facilitate adhesion between the plastic flexible tool and the inner surface of the cavity during use.

376. The applicator of claim 375 wherein the body comprises a curved portion having an ergonomic shape to facilitate grasping of the body.

377. The applicator of claim 375 wherein at least a portion of the inner surface of the cavity is defined by a lower portion of the top section.

378. The applicator of claim 375 wherein the bottom section is adapted to absorb a lubricating agent during use.

379. The applicator of claim 375 wherein the bottom section comprises a foam having between about 60 pores per square inch and about 150 pores per square inch.

380. The applicator of claim 375 herein the second compressible material can absorb liquid lubricating agent during use, the second compressible material being adapted to dispense an amount of liquid lubricating agent upon being compressed, and wherein the amount of liquid lubricating agent dispensed varies as a function of a degree to which the second compressible material is compressed.

381. The applicator of claim 375 wherein the applicator has a density that causes the applicator to float on water.

382. The applicator of claim 375 wherein the top section is substantially impermeable to liquid lubricating agents.

383. The applicator of claim 375 wherein the body comprises foam for storing a lubricating agent and dispensing the lubricating agent to the surface during use.

384. The applicator of claim 375 wherein the plastic flexible tool is positionable within the cavity during use such that the body covers at least about half of a surface area of the plastic flexible tool.

385. The applicator of claim 375 further comprising a hook-loop fastening system portion on the inner surface for forming a fixable engagement with a mating surface of the plastic flexible tool during use.

386. The applicator of claim 375 wherein the bottom section comprises a bottom surface located about a perimeter of the cavity, and wherein the cavity is adapted to contain the plastic flexible tool such that the tool is recessed within the cavity with respect to the bottom surface during use.

387. The applicator of claim 375 wherein the bottom section comprises a bottom surface about a perimeter of the cavity, and wherein the cavity is adapted to contain the plastic flexible tool such that the tool is recessed within the cavity with respect to the bottom surface, and wherein the bottom section is compressible to cause the plastic flexible tool to become substantially flush with the bottom surface during use.

388. The applicator of claim 375, further comprising a pressure-sensitive adhesive connecting the top section and the bottom section together.

389. The applicator of claim 375, further comprising a glue disposed between the top section and the bottom section.

390. The applicator of claim 375 wherein the first material is a plastomer foam and the second compressible material is an elastomer foam.

391. The applicator of claim 375 wherein the first material is a crosslinked polyethylene foam, and wherein the compressible material is a urethane foam.

392. The applicator of claim 375 wherein the first material is a closed-cell metallocene polyolefin foam, and wherein the second compressible material is a urethane foam.

* * * * *

UNITED STATES PATENT AND TRADEMARK OFFICE

CERTIFICATE OF CORRECTION

PATENT NO. : 6,241,579 B1
DATED : June 5, 2001
INVENTOR(S) : Paul D. Miller, Dennis L. Dehn It is certified that error appears in the above-identified patent and that said Letters Patent is hereby corrected as shown below:

Column 13, claim 3,
Line 59, please delete "definge" and substitute therefor -- defined --.

Column 21, claim 89,
Line 8, please delete "surfaces" and substitute therefor -- surface --.

Column 23, claim 119,
Line 17, please delete "the," and substitute therefor -- the --.

Column 24, claim 143,
Line 40, please delete "flirter" and substitute therefor -- further --.

Column 29, claim 231,
Line 45, please delete, "AST" and substitute therefor -- ASTM --.

Column 29, claim 232,
Line 49, please delete, "60" and substitute therefor -- 48 --.

Column 29, claim 233,
Line 55, please delete, "60" and substitute therefor -- 48 --.

Column 29, claim 234,
Line 59, please delete, "60" and substitute therefor -- 48 --.

Column 29, claim 235,
Line 61, please delete, "60" and substitute therefor -- 48 --:

Column 29, claim 236,
Line 65, please delete, "60" and substitute therefor -- 48 --.

UNITED STATES PATENT AND TRADEMARK OFFICE

CERTIFICATE OF CORRECTION

PATENT NO. : 6,241,579 B1
DATED : June 5, 2001
INVENTOR(S) : Paul D. Miller, Dennis L. Dehn It is certified that error appears in the above-identified patent and that said Letters Patent is hereby corrected as shown below:

Column 31, claim 269,
Line 62, please delete "the," and substitute therefor -- the --.

Column 32, claim 272,
Line 6, please delete "definable" and substitute therefor -- deformable --.

Column 35, claim 330,
Line 29, please delete "73SF" and substitute therefor -- 73° F --.

Column 36, claim 353,
Line 51, please delete "dog" and substitute therefor -- during --.

Column 38, claim 380,
Line 35, please delete "herein" and substitute therefor -- wherein --.

Signed and Sealed this

Fourth Day of December, 2001

*Attest:*

Nicholas P. Godici

NICHOLAS P. GODICI
*Acting Director of the United States Patent and Trademark Office*

*Attesting Officer*